US010025250B2

(12) United States Patent
Tamura et al.

(10) Patent No.: US 10,025,250 B2
(45) Date of Patent: Jul. 17, 2018

(54) IMAGE FORMING APPARATUS THAT CORRECTS COLOR MISREGISTRATION

(71) Applicant: CANON KABUSHIKI KAISHA, Tokyo (JP)

(72) Inventors: Kentaro Tamura, Komae (JP); Shinichi Takata, Abiko (JP); Yushi Oka, Abiko (JP); Hiroshi Matsumoto, Toride (JP); Ryou Sakaguchi, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/630,073

(22) Filed: Jun. 22, 2017

(65) Prior Publication Data

US 2018/0004111 A1 Jan. 4, 2018

(30) Foreign Application Priority Data

Jun. 29, 2016 (JP) ..... 2016-128603

(51) Int. Cl.
*G03G 15/00* (2006.01)
*G03G 15/01* (2006.01)

(52) U.S. Cl.
CPC ..... *G03G 15/5058* (2013.01); *G03G 15/0131* (2013.01); *G03G 15/6561* (2013.01); *G03G 2215/0161* (2013.01)

(58) Field of Classification Search
CPC ..... G03G 15/5058; G03G 15/6561; G03G 15/6564; G03G 2215/0158; G03G 2215/0161
See application file for complete search history.

(56) References Cited

U.S. PATENT DOCUMENTS

| | | | | |
|---|---|---|---|---|
| 8,837,994 | B2 | 9/2014 | Kuroki et al. | |
| 2010/0226694 | A1* | 9/2010 | Osawa | G03G 15/0194 399/301 |
| 2015/0241808 | A1* | 8/2015 | Oka | G03G 15/01 399/301 |
| 2015/0242714 | A1* | 8/2015 | Oka | G06K 15/027 358/1.5 |
| 2016/0327896 | A1* | 11/2016 | Oka | G03G 15/5058 |

* cited by examiner

*Primary Examiner* — Carla Therrien
(74) *Attorney, Agent, or Firm* — Rossi, Kimms & McDowell LLP

(57) ABSTRACT

An image forming apparatus capable of performing color misregistration correction at image forming speeds while reducing downtime. Image forming units form images of different colors. The formed images are transferred to an intermediate transfer belt. A pattern sensor detects color misregistration amounts of color patterns formed on the intermediate transfer belt. A CPU causes the image forming units to form first color patterns at a first speed and the pattern sensor to detect first color misregistration amounts, and causes the former to form second color patterns at a second speed different from the first speed and the latter to detect second color misregistration amounts. The CPU determines third color misregistration amounts at a third speed based on the first and second color misregistration amounts. The third speed is different from the first and second speeds.

10 Claims, 14 Drawing Sheets

| SHEET TYPE | THICKNESS (UNIT: g/m2) | IMAGE FORMING SPEED | ACTUAL SPEED (UNIT: mm/s) |
|---|---|---|---|
| PLAIN PAPER 1 | 60-79 | FIRST IMAGE FORMING SPEED | 300 |
| PLAIN PAPER 2 | 80-99 | FIRST IMAGE FORMING SPEED | 300 |
| PLAIN PAPER 3 | 100-119 | THIRD IMAGE FORMING SPEED | 200 |
| THICK PAPER 1 | 120-139 | SECOND IMAGE FORMING SPEED | 100 |
| THICK PAPER 2 | 140-159 | SECOND IMAGE FORMING SPEED | 100 |
| THICK PAPER 3 | 160-179 | SECOND IMAGE FORMING SPEED | 100 |

*FIG. 8A*

| IMAGE FORMING SPEED (mm/s) | 300 |
|---|---|

| | THEORETICAL VALUE (μm) | THEORETICAL VALUE (μsec) | DETECTED VALUE (μsec) | MIS-REGISTRATION AMOUNT (μsec) | MIS-REGISTRATION AMOUNT (μm) |
|---|---|---|---|---|---|
| BETWEEN Y-M | 12700 | 42333 | 42328 | -5 | -2 |
| BETWEEN Y-C | 25400 | 84667 | 84711 | 44 | 13 |
| BETWEEN Y-K | 38100 | 127000 | 126973 | -27 | -8 |

*FIG. 8B*

| IMAGE FORMING SPEED (mm/s) | 100 |
|---|---|

| | THEORETICAL VALUE (μm) | THEORETICAL VALUE (μsec) | DETECTED VALUE (μsec) | MIS-REGISTRATION AMOUNT (μsec) | MIS-REGISTRATION AMOUNT (μm) |
|---|---|---|---|---|---|
| BETWEEN Y-M | 12700 | 127000 | 127552 | 552 | 55 |
| BETWEEN Y-C | 25400 | 254000 | 254790 | 790 | 79 |
| BETWEEN Y-K | 38100 | 381000 | 381630 | 630 | 63 |

*FIG. 8C*

| IMAGE FORMING SPEED (mm/s) | 200 |
|---|---|

| | THEORETICAL VALUE (μm) | THEORETICAL VALUE (μsec) | DETECTED VALUE (μsec) | MIS-REGISTRATION AMOUNT (μsec) | MIS-REGISTRATION AMOUNT (μm) |
|---|---|---|---|---|---|
| BETWEEN Y-M | 12700 | 63500 | 63632 | 132 | 26 |
| BETWEEN Y-C | 25400 | 127000 | 127233 | 233 | 46 |
| BETWEEN Y-K | 38100 | 190500 | 190636 | 136 | 27 |

FIG. 8D

| | MISREGISTRATION AMOUNT DIFFERENCE (μm) BETWEEN FIRST IMAGE FORMING SPEED AND SECOND IMAGE FORMING SPEED |
|---|---|
| Y-M (dL1') | 57 |
| Y-C (dL2') | 66 |
| Y-K (dL3') | 71 |

FIG. 8E

| | MISREGISTRATION AMOUNT DIFFERENCE (μm) BETWEEN FIRST IMAGE FORMING SPEED AND THIRD IMAGE FORMING SPEED |
|---|---|
| Y-M (dL1") | 28 |
| Y-C (dL2") | 33 |
| Y-K (dL3") | 35 |

FIG. 9A (NUMBER OF SHEETS SUBJECTED TO IMAGE FORMATION IS 35000)

| | MISREGISTRATION AMOUNT DIFFERENCE (μm) BETWEEN FIRST IMAGE FORMING SPEED AND SECOND IMAGE FORMING SPEED |
|---|---|
| Y-M (dL1') | 14 |
| Y-C (dL2') | 20 |
| Y-K (dL3') | 18 |

| | MISREGISTRATION AMOUNT DIFFERENCE (μm) BETWEEN FIRST IMAGE FORMING SPEED AND THIRD IMAGE FORMING SPEED |
|---|---|
| Y-M (dL1") | 7 |
| Y-C (dL2") | 10 |
| Y-K (dL3") | 9 |

FIG. 9B (NUMBER OF SHEETS SUBJECTED TO IMAGE FORMATION IS 40000)

| | MISREGISTRATION AMOUNT DIFFERENCE (μm) BETWEEN FIRST IMAGE FORMING SPEED AND SECOND IMAGE FORMING SPEED |
|---|---|
| Y-M (dL1') | 35 |
| Y-C (dL2') | 44 |
| Y-K (dL3') | 46 |

| | MISREGISTRATION AMOUNT DIFFERENCE (μm) BETWEEN FIRST IMAGE FORMING SPEED AND THIRD IMAGE FORMING SPEED |
|---|---|
| Y-M (dL1") | 17 |
| Y-C (dL2") | 22 |
| Y-K (dL3") | 23 |

FIG. 9C (NUMBER OF SHEETS SUBJECTED TO IMAGE FORMATION IS 50000)

| | MISREGISTRATION AMOUNT DIFFERENCE (μm) BETWEEN FIRST IMAGE FORMING SPEED AND SECOND IMAGE FORMING SPEED |
|---|---|
| Y-M (dL1') | 57 |
| Y-C (dL2') | 66 |
| Y-K (dL3') | 71 |

| | MISREGISTRATION AMOUNT DIFFERENCE (μm) BETWEEN FIRST IMAGE FORMING SPEED AND THIRD IMAGE FORMING SPEED |
|---|---|
| Y-M (dL1") | 28 |
| Y-C (dL2") | 33 |
| Y-K (dL3") | 35 |

FIG. 9D (NUMBER OF SHEETS SUBJECTED TO IMAGE FORMATION IS 60000)

| | MISREGISTRATION AMOUNT DIFFERENCE (μm) BETWEEN FIRST IMAGE FORMING SPEED AND SECOND IMAGE FORMING SPEED |
|---|---|
| Y-M (dL1') | 92 |
| Y-C (dL2') | 92 |
| Y-K (dL3') | 110 |

| | MISREGISTRATION AMOUNT DIFFERENCE (μm) BETWEEN FIRST IMAGE FORMING SPEED AND THIRD IMAGE FORMING SPEED |
|---|---|
| Y-M (dL1") | 46 |
| Y-C (dL2") | 46 |
| Y-K (dL3") | 55 |

IMAGE FORMING APPARATUS THAT CORRECTS COLOR MISREGISTRATION

BACKGROUND OF THE INVENTION

Field of the Invention

The present invention relates to an image forming apparatus that forms a color image on a sheet by superimposing a plurality of images of different colors one upon another, and more particularly to an image forming apparatus that corrects color misregistration between the respective images.

Description of the Related Art

A color image forming apparatus forms a color image by superimposing a plurality of images of different colors on an intermediate transfer member. Therefore, relative positional displacement between images of different colors formed on the intermediate transfer member causes color misregistration. An image forming apparatus disclosed in U.S. Pat. No. 8,837,994 forms pattern images of respective color components on an intermediate transfer member, detects color misregistration amounts, and adjusts the writing start time of an image of each color component based on results of the detection.

Incidentally, the image forming apparatus is capable of forming an image on various types of sheets. The image forming apparatus decides an amount of heat for fixing a toner image according to the type of a sheet. For example, the amount of heat required for fixing a toner image on thick paper is larger than the amount of heat required for fixing a toner image on plain paper. Therefore, the image forming apparatus is equipped with a mode for performing image formation at an image forming speed lower than an image forming speed applied to plain paper.

It is known that a color misregistration amount caused by expansion or contraction of optical parts does not depend on the image forming speed. Therefore, the image forming apparatus calculates correction amounts for correcting color misregistration by forming patterns at a predetermined image forming speed. Then, when the image forming apparatus performs image formation at a plurality of image forming speeds, the writing start time of each color component is adjusted based on an associated one of the correction amounts.

In recent years, types of sheets have diversified, and hence the number of image forming speeds which the image forming apparatus can set has also been increased. That is, the range of image forming speeds is increased. It comes to be known that due to the increase in the range of image forming speeds, color misregistration caused by aging of components involved in the conveyance of sheets and images has become noticeable. For example, an intermediate transfer member is degraded by abrasion of a drive roller for driving the intermediate transfer member or being soiled by scattering of toners. This sometimes causes the intermediate transfer member to slip with respect to the drive roller. Accordingly, images of respective colors are transferred to the intermediate transfer member at times deviating from proper times, causing color misregistration. It has come to be known that changes in the amount of slippage depend on image forming speeds. More specifically, the amount of slippage at a lower image forming speed becomes larger than the amount of slippage at a higher image forming speed. Therefore, assuming that color misregistration amounts caused at respective image forming speeds are all corrected by a color misregistration correction amount determined using e.g. a highest image forming speed, a color misregistration amount at a lower image forming speed, particularly at the lowest image forming speed, becomes larger. Inversely, assuming that color misregistration amounts caused at respective image forming speeds are all corrected by a color misregistration correction amount determined using e.g. a lowest image forming speed, a color misregistration amount at a higher image forming speed, particularly at the highest image forming speed, becomes larger. To accurately correct such color misregistration dependent on the image forming speed, it is desirable that the apparatus is configured to acquire color misregistration amounts at a plurality of image forming speeds, respectively. However, it takes time to acquire color misregistration amounts, and hence assuming that the apparatus is configured to acquire color misregistration amounts at a plurality of image forming speeds, respectively, there is a problem that downtime, which is a time period during which a user cannot perform image formation, becomes longer.

SUMMARY OF THE INVENTION

The present invention provides an image forming apparatus which is capable of performing color misregistration correction at a plurality of respective image forming speeds while reducing downtime.

The present invention provides an image forming apparatus comprising a plurality of image forming units configured to form images each having a different color, an intermediate transfer member onto which the images formed by the plurality of image forming units are transferred, a detection unit configured to detect a color pattern formed on the intermediate transfer member, the color pattern being used for detecting color misregistration, a controller configured to control the plurality of image forming units to form a plurality of first color patterns having different colors at a first image forming speed on the intermediate transfer member, control the detection unit to detect first color misregistration amounts, control the plurality of image forming units to form a plurality of second color patterns having the different colors at a second image forming speed different from the first image forming speed on the intermediate transfer member, and control the detection unit to detect second color misregistration amounts, a generation unit configured to generate first correlation data based on the first color misregistration amounts and the second color misregistration amounts, and generate second correlation data based on the first correlation data, and a correction unit configured to correct an image formation position based on the first color misregistration amounts in a case where the image forming units forms images at the first image forming speed, correct the image formation position based on the first color misregistration amounts and the first correlation data generated by the generation unit in a case where the image forming units forms images at the second image forming speed, and correct the image formation position based on the first color misregistration amounts and the second correlation data generated by the generation unit in a case where the image forming units forms images at a third image forming speed, wherein the third image forming speed is different from the first image forming speed, and wherein the third image forming speed is different from the second image forming speed.

According to the present invention, it is possible to perform color misregistration correction at a plurality of respective image forming speeds while reducing downtime.

Further features of the present invention will become apparent from the following description of exemplary embodiments (with reference to the attached drawings).

BRIEF DESCRIPTION OF THE DRAWINGS

FIG. 8A is a diagram showing an example of results of color misregistration detection performed at a first image forming speed.

FIG. 8B is a diagram showing an example of results of color misregistration detection performed at a second image forming speed.

FIG. 8C is a diagram showing an example of results of color misregistration detection performed at a third image forming speed.

FIG. 8D is a diagram of misregistration amount differences between color misregistration amounts at the first image forming speed and color misregistration amounts at the second image forming speed.

FIG. 8E is a diagram of misregistration amount differences between the color misregistration amounts at the first image forming speed and color misregistration amounts at the third image forming speed.

FIGS. 9A to 9D are diagrams showing results of calculation of the above-mentioned two types of misregistration amount differences between the colors, which is performed when the number of sheets subjected to image formation reaches each different number.

DESCRIPTION OF THE EMBODIMENTS

The present invention will now be described in detail below with reference to the accompanying drawings showing embodiments thereof.

Figure 1:
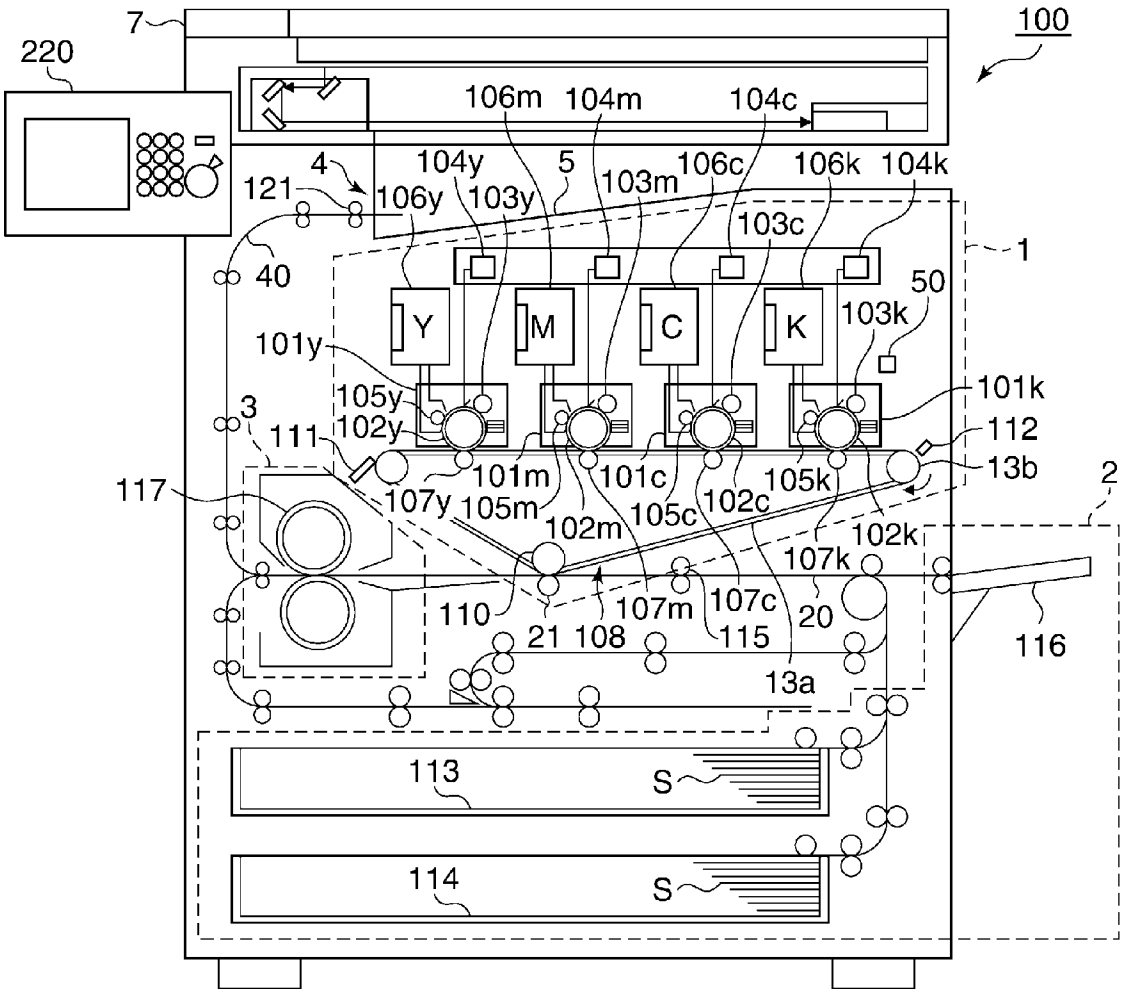
FIG. 1 is a schematic cross-sectional view of an image forming apparatus according to a first embodiment of the invention.

FIG. 1 is a schematic cross-sectional view of an image forming apparatus according to a first embodiment of the present invention. As the image forming apparatus, there is illustrated an image forming apparatus of an electrophotographic type. The present invention, however, can be similarly applied to any suitable image forming apparatus insofar as the image forming apparatus forms a multi-color image by individually forming a plurality of images of different colors and then superimposing the images upon each other. Note that the image forming apparatus may be commercially manufactured, as any of a printing apparatus, a printer, a copy machine, a multifunction peripheral, and a facsimile machine.

Next, a description will be given of the image forming apparatus 100 with reference to FIG. 1. An image forming section 1 is a printer engine that forms a multi-color toner image, and is comprised of a plurality of image forming units configured to form respective toner images of different colors at one of a plurality of image forming speeds. A sheet feeder 2 is a unit that feeds a sheet S to the image forming section 1. The sheet may be referred to as a recording material, a recording sheet, a recording medium, a sheet, a transfer material, or a transfer sheet. A fixing device 3 is a unit that fixes the multi-color toner image on the sheet S. Toner reservoirs 106 are units that stores toners of the respective colors. Note that the colors of the toners used in the image forming apparatus 100 are yellow (Y), magenta (M), cyan (C), and black (K). Suffixes y, m, c, and k denoting the colors of the toners are sometimes attached to respective ends of associated reference numerals appearing in figures and the specification, but they are normally omitted. A discharge section 4 is a unit that discharges sheets S having multi-color toner images fixed thereon out of the image forming apparatus 100. A stacking section 5 is a unit on which discharged sheets S are stacked. An image reader 7 is a unit that reads an original. A console section 220 is a unit that inputs an instruction to the image forming apparatus 100 or displays information.

The image forming section 1 includes four process cartridges 101 that are associated with Y, M, C, and K, respectively, and are removably mounted on the image forming apparatus 100. Each process cartridge 101 is provided with a photosensitive drum 102, a charging roller 103 that charges the photosensitive drum 102 by applying a predetermined voltage to the photosensitive drum 102, and a developing sleeve 105 that develops a latent image formed on the photosensitive drum 102 by applying toner to the latent image. Each toner reservoir 106 as well may be part of an associated one of the process cartridges 101. Arranged above each process cartridge 101 is a laser scanner 104 for forming a latent image on the photosensitive drum 102. An intermediate transfer unit 108 is arranged below the process cartridges 101. The laser scanner 104 is an exposure device that irradiates the photosensitive drum 102, using a rotary polygon mirror or a vibration mirror, with a modulated laser beam output from a laser diode, to scan the uniformly charged photosensitive drum 102 in a longitudinal direction (main scanning direction) thereof. A thermistor 50 mounted in the vicinity of a process cartridge 101*k* is an example of a temperature detection unit configured to detect an internal temperature of the image forming apparatus 100. The intermediate transfer unit 108 includes an intermediate transfer belt 13*a*, a drive roller 13*b*, primary transfer rollers 107 for bringing the intermediate transfer belt 13*a* into contact with the photosensitive drums 102, and an inner roller 110. The intermediate transfer unit 108 is an example of an image bearing member or an intermediate transfer member that is configured to bear a multi-color toner image formed by superimposing toner images of different colors formed by the image forming units, respectively, one upon another. An outer roller 21 forms a transfer nip together with the inner roller 110. A timing at which the sheet S is caused to enter the transfer nip by a registration roller 115 in a sheet conveying path 20 is controlled. An intermediate transfer member cleaner 111 collects residual toner which could not be completely transferred by the inner roller 110 and adjustment toner unintended to be transferred onto the sheet S. A pattern sensor 112 detects the edge of a change in the density of a pattern formed on the intermediate transfer belt 13*a*. The sheet feeder 2 includes a first sheet feed cassette 113, a second sheet feed cassette 114, and a manual feed tray 116. The fixing device 3 includes a fixing roller 117 that rotates while heating a roller surface thereof. The sheet S is discharged onto the stacking section 5 by a discharge roller pair 121 arranged on a discharge path 40.

Figure 2:
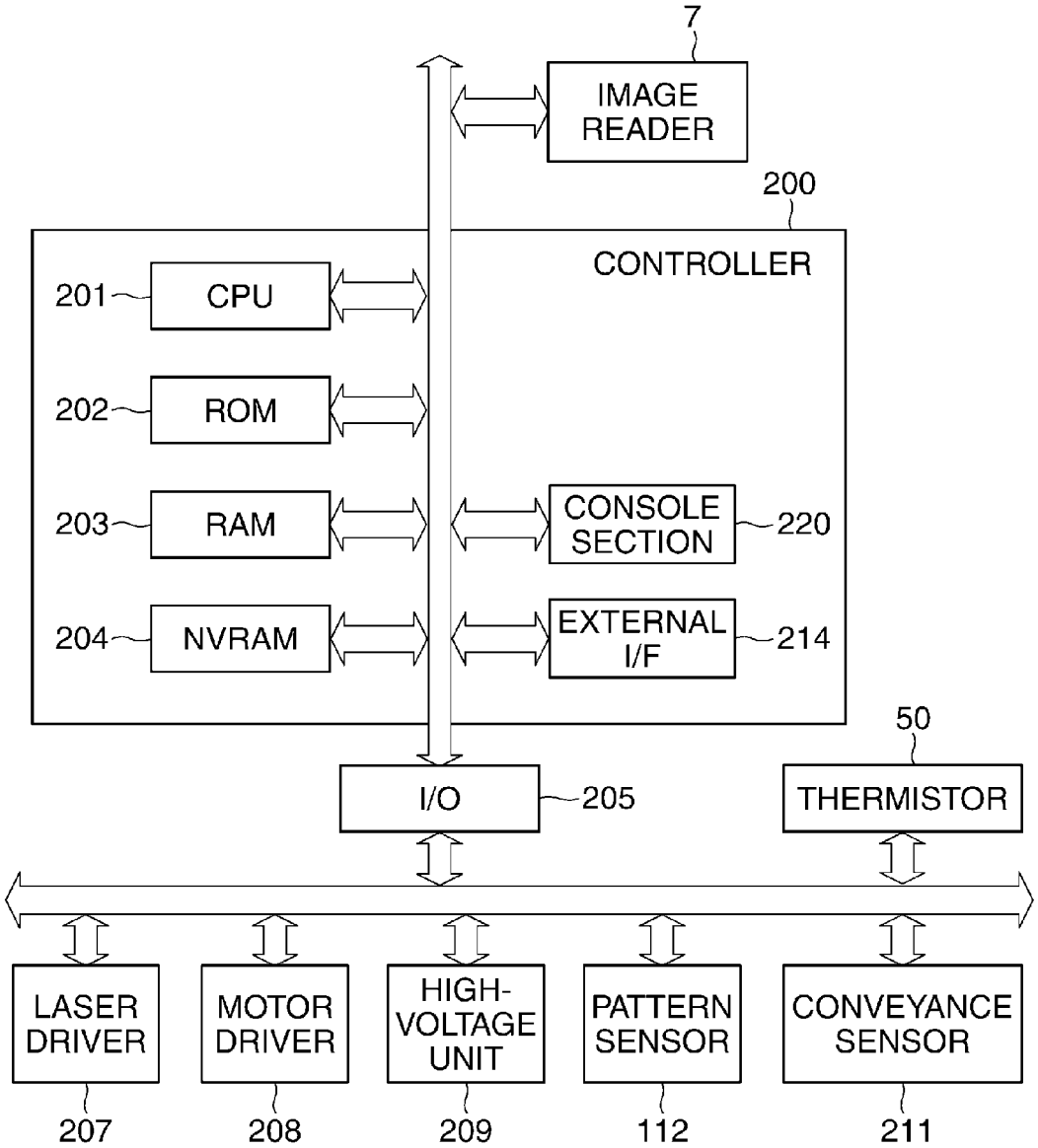
FIG. 2 is a block diagram of a control system of the image forming apparatus.

FIG. 2 is a block diagram of a control system of the image forming apparatus 100. The control system of the image forming apparatus 100 will be described with reference to FIG. 2. The control system of the image forming apparatus 100 includes a CPU 201, a ROM 202, a RAM 203, a NVRAM 204, the console section 220, and an external interface 214. The CPU 201 performs centralized control over the units of the image forming apparatus 100. The ROM 202 is a storage device that stores commands for control executed by the CPU 201 as programs. The RAM 203 is a storage device used as a work area necessary for the CPU 201 to control the image forming apparatus 100. The RAM 203 is also capable of storing image data created by the image reader 7 which reads an original, image data received via the external interface 214, and so forth. The NVRAM 204 is a nonvolatile storage device that stores data, such as the number of sheets subjected to image formation, and a total operating time of each process cartridge. The external interface 214 is connected to a network supporting communication protocols, such as TCP/IP, and receives an instruction for executing a print job from a computer connected to the network. The external interface 214 may transmit information on the image forming apparatus 100 to the computer. An I/O 205 is comprised of input/output ports of the CPU 201, to which are connected the thermistor 50, a laser driver 207, a motor driver 208, a high-voltage unit 209, the pattern sensor 112, and conveyance sensors 211. The laser driver 207 controls the laser scanner 104 according to an image signal generated from image data. The motor driver 208 is a unit for driving e.g. rollers. Motors, not shown, drive the photosensitive drums 102, the intermediate transfer belt 13*a*, conveying rollers and the registration roller 115 provided on the conveying path, and sheet feed rollers provided for the first sheet feed cassette 113, the second sheet feed cassette 114, and the manual feed tray 116. The motor driver 208 controls the rotations of these motors. The high-voltage unit 209 controls voltage applied or current supplied to the charging rollers 103, the developing sleeves 105, and the primary transfer rollers 107, included in the process cartridges 101, and the outer roller 21. The conveyance sensors 211 are each a device that detects the presence/absence of a sheet S in an associated one of the first sheet feed cassette 113, the second sheet feed cassette 114, and the manual feed tray 116, and the position of a sheet S being conveyed on the conveying path. The pattern sensor 112 is an example of a detection unit configured to detect a distance from a pattern of a reference color to each of a plurality of patterns of different colors, which are formed on the intermediate transfer belt 13*a* by the image forming section 1, and are other than the pattern of the reference color. In the present embodiment, Y is adopted as the reference color. Note that although in the present embodiment, Y is set as the reference color, Y may be replaced by any of M, C, and K.

Figure 3A:
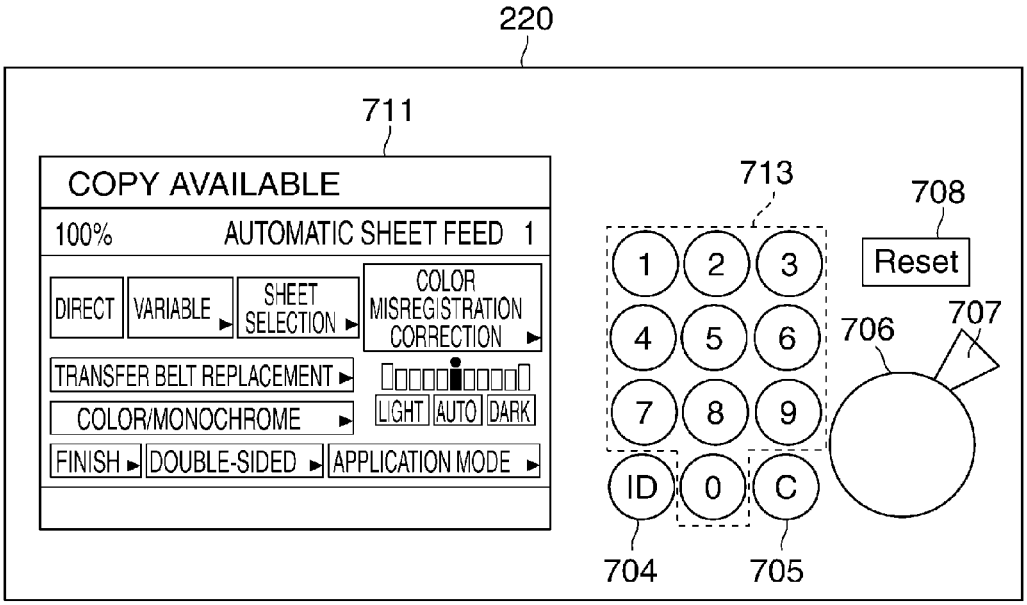
FIG. 3A is a schematic view showing the appearance of a console section.
Figure 3B:
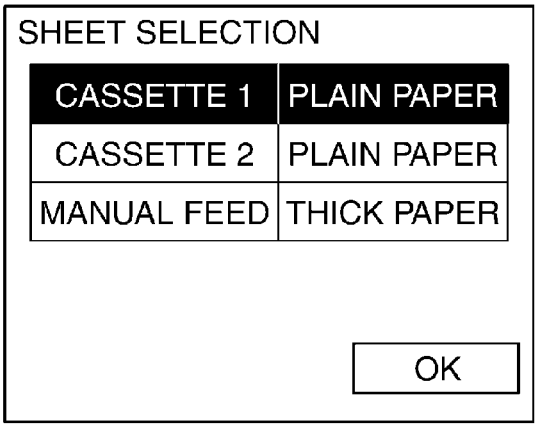
FIG. 3B is a view of a sheet selection screen displayed on a display section of the console section.
Figure 3C:
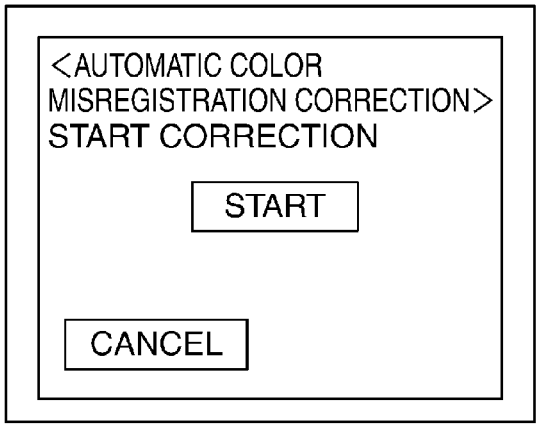
FIG. 3C is a view of a message screen including a start button for starting color misregistration correction, displayed on the display section.

FIG. 3A is a schematic view of the appearance of the console section 220. The console section 220 includes a display section 711. FIGS. 3B and 3C are examples of the display on the display section 711. In the console section 220, a start key 706 is used to start an image forming operation. A stop key 707 is used to stop the image forming operation. Ten keys 713 are used for inputting numerals. An ID key 704 is used to perform user authentication. A clear key 705 is used to clear e.g. input numerals. A reset key 708 is used to initialize input settings. The display section 711 is a display device incorporating a touch panel sensor, and displays soft keys each of which can be operated by a touch made thereon by the user. When the user selects "sheet selection" which is one of the soft keys, a sheet selection screen as shown in FIG. 3B is displayed on the display section 711. The user designates a type of sheets (sheet type) for use by selecting one of the first sheet feed cassette 113, the second sheet feed cassette 114, and the manual feed tray 116, via the sheet selection screen. The CPU 201 stores this information in the RAM 203, and performs image formation control based on the information. For example, the CPU 201 selects an image formation mode (image forming speed) according to the sheet type. A message screen including a start button for manually starting color misregistration correction is displayed on the display section 711, as shown in FIG. 3C. Although the CPU 201 basically performs the color misregistration correction using, as a start condition (trigger), the number of sheets subjected to image formation or a change in the internal temperature of the image forming apparatus, the CPU 201 may perform the color misregistration correction when the pressing of the start button is detected.

Next, the image forming operation which is controlled by the CPU 201 will be described mainly with reference to FIGS. 1 and 2. The CPU 201 applies a predetermined voltage to the charging roller 103 via the high-voltage unit 209 to uniformly charge the surface of the photosensitive drum 102 with a predetermined polarity and potential. The CPU 201 performs image processing on image data stored in the RAM 203 and outputs an image signal generated by the image processing to the laser driver 207 to thereby control the laser scanner 104. With this control, an electrostatic latent image is formed on the photosensitive drum 102 by a laser beam output from the laser scanner 104. The CPU 201 controls the toner reservoir 106 via the motor driver 208 to supply the process cartridge 101 with an associated toner. Further, the CPU 201 causes the motor driver 208 to rotate the developing sleeve 105, whereby the developing sleeve 105 is coated with the toner as a developer. The electrostatic latent image formed on the photosensitive drum 102 is developed by the toner attached from the developing sleeve 105, whereby a toner image is formed. The toner image is transferred onto the intermediate transfer belt 13*a* at a primary transfer section which is a contact portion between the photosensitive drum 102 and the intermediate transfer belt 13*a*, by a primary transfer bias which the high-voltage unit 209 applies to the primary transfer roller 107. The above image forming operation is sequentially performed in each of the four process cartridges 101. The toner images of different colors are multi-transferred onto the intermediate transfer belt 13*a*, to form a multi-color toner image thereon.

On the other hand, the CPU 201 controls the sheet feeder 2 via the motor driver 208 in accordance with the image forming operation to feed a sheet S and convey the same along the sheet conveying path 20. The CPU 201 controls the registration roller 115 via the motor driver 208 to correct a skew of the sheet S and match the position of the sheet S to the position of the multi-color toner image on the intermediate transfer belt 13*a*. The sheet S passes between the outer roller 21 to which a secondary transfer bias is applied and the inner roller 110. This causes the multi-color toner image on the intermediate transfer belt 13*a* to be transferred onto the sheet S. Then, the sheet S is sent to the fixing device 3.

The CPU 201 controls the fixing device 3 to apply heat and pressure to the sheet S. As a consequence, the toners of the multi-color toner image are melted to fix a multi-color visible image on the sheet S. The CPU 201 controls the discharge roller pair 121 of the discharge section 4 via the motor driver 208 to discharge the sheet S from the discharge path 40 onto the stacking section 5.

Next, a description will be given of the image forming speed. During image formation, the photosensitive drums 102, the drive roller 13*b*, and the fixing roller 117 rotate at the same speed. This is because the formation of toner images, and the transfer and the fixation of a multi-color toner image onto a sheet S are performed as a series of processing operations. The conveying speed (moving speed) of a sheet S during image formation is the image forming speed. Incidentally, the amount of heat required for fixing the multi-color toner image on a sheet S is different depending on the type (material, thickness, etc.) of the sheet S. For example, the amount of required heat is larger as the thickness of the sheet S is larger. If the image forming speed is reduced, a time period over which the sheet S having a multi-color toner image transferred thereon is in contact with the fixing roller 117, that is, a time period over which heat is supplied to the sheet S is increased. This makes it possible to achieve application of an amount of heat suitable for the thickness of the sheet S. As described hereinabove, the CPU 201 determines the image forming speed according to the type of the sheet S.

Figures 4, 5:
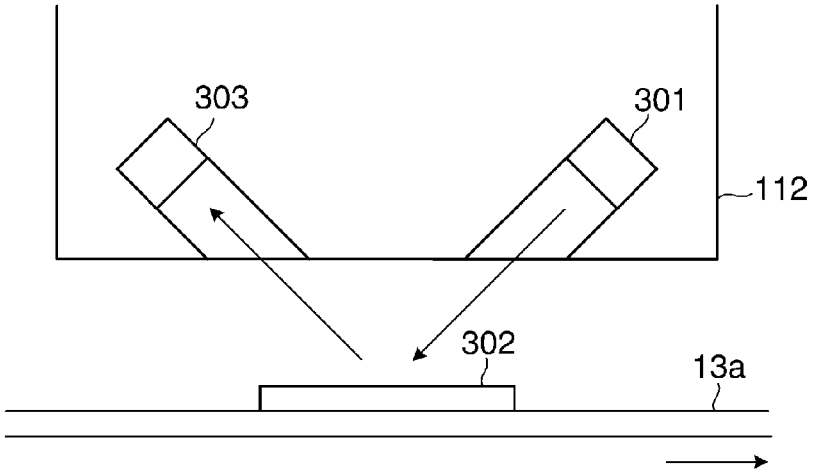
FIG. 4 is a diagram showing a relationship between the sheet type and the image forming speed.
FIG. 5 is a diagram of a pattern sensor.

Let it be assumed that the image forming apparatus 100 supports a first image forming speed, a second image forming speed, and a third image forming speed. Image forming speeds dependent on the types of sheets S are shown in FIG. 4 (thicknesses are assumed to be basis weights, in the illustrated example). That is, the first image forming speed is 300 mm/s, the second image forming speed is 100 mm/s, and the third image forming speed is 200 mm/s. Six types are assumed as the types of the sheets S. According to FIG. 4, the first image forming speed is applied to plain paper 1 and plain paper 2, and the second image forming speed is applied to thick paper 1, thick paper 2, and thick paper 3. The third image forming speed is applied to plain paper 3. Hereinafter, "the first image forming speed", "the second image forming speed", and "the third image forming speed" are also simplified as "the first speed", "the second speed", and "the third speed".

Next, a description will be given of color misregistration correction control. The CPU 201 controls the laser driver 207 to adjust the writing start times of toner images of the colors (magenta, cyan, and black) other than the reference color (yellow), to thereby perform color misregistration correction in a sub scanning direction (conveying direction of the intermediate transfer belt 13*a*). The CPU 201 is capable of performing color misregistration correction using different correction amounts for the first speed, second speed, and third speed, respectively. The CPU 201 corrects color misregistration by correcting the writing start times of toner images of the colors other than the reference color based on a distance from the pattern of the reference color to each pattern other than the pattern of the reference color.

FIG. 5 is a diagram of the pattern sensor 112. The pattern sensor 112 includes a light emitting section 301 formed by an infrared LED, and a light receiving section 303 formed by a phototransistor. The light emitting section 301 and the light receiving section 303 are mounted on the pattern sensor 112 at such angles that infrared light emitted from the light emitting section 301 is reflected by the intermediate transfer belt 13*a*, and further the reflected light enters the light receiving section 303. Note that the light receiving section 303 may be arranged at a position where it can receive regular reflected light, or may be arranged at a position where it can receive scattered light. Since the reflection characteristics of a surface of the intermediate transfer belt 13*a* are different from the reflection characteristics of images of a pattern group 302 (images for detection) formed by the toners for detecting a color misregistration, the amount of light reflected from the surface of the intermediate transfer belt 13*a* and the amount of light reflected from each image for detection, which are received by the light receiving section 303, are different. The light receiving section 303 converts received light to an electric signal (output signal) having an amplitude dependent on the amount of the received light. The voltage of the output signal converted by the light receiving section 303 becomes lower if the amount of the reflected light is small, but becomes higher if the amount of the reflected light is large. In general, as the amount of toner of a toner image formed on the intermediate transfer belt 13*a* is larger, the amount of reflected light becomes smaller. Therefore, as the voltage of an output signal from the pattern sensor 112 is higher, the density of a formed toner image is lower, and as the voltage of an output signal from the pattern sensor 112 is lower, the density of a formed toner image is higher. As described above, there is a correlation between the voltage of an output signal and the density of a toner image.

Figure 6:
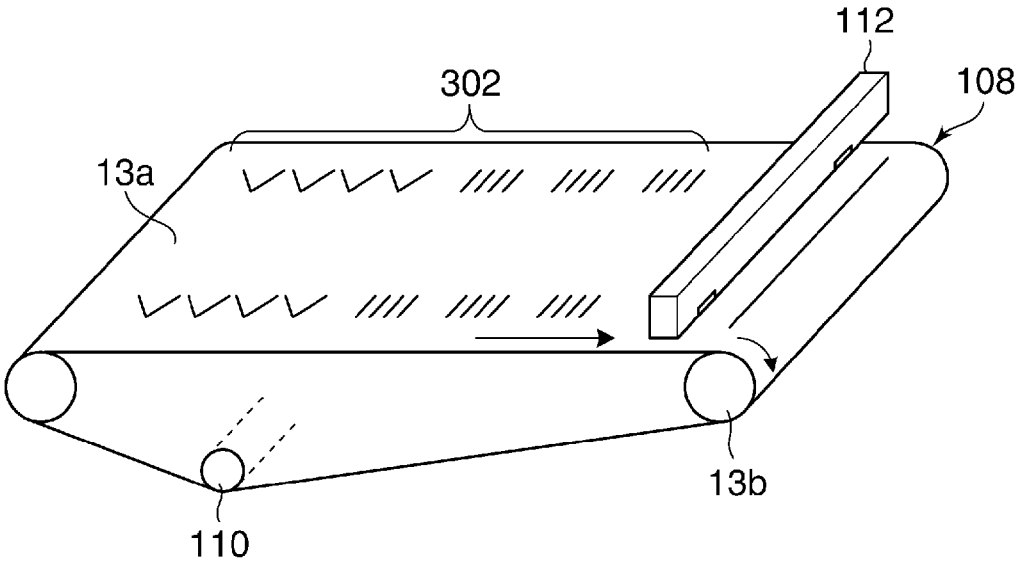
FIG. 6 is a perspective view of an intermediate transfer belt having a pattern sensor provided thereabove.

FIG. 6 is a perspective view of the intermediate transfer belt 13*a* having the pattern sensor 112 provided thereabove. The pattern sensor 112, the intermediate transfer belt 13*a*, and the pattern group 302 are arranged as shown in FIG. 6. The pattern sensor 112 continuously reads a plurality of patterns (pattern group 302) formed along the direction of rotation of the intermediate transfer belt 13*a* (the sub scanning direction). As shown in FIG. 6, each of patterns each formed by four lines can be formed by one line of the reference color and three lines of the colors other than the reference color. Note that each of patterns of "<" can be used also for color misregistration correction in the main scanning direction and magnification correction. When the color misregistration correction in the main scanning direction or the magnification correction is not performed, the patterns of "<" may be omitted.

Figure 7:
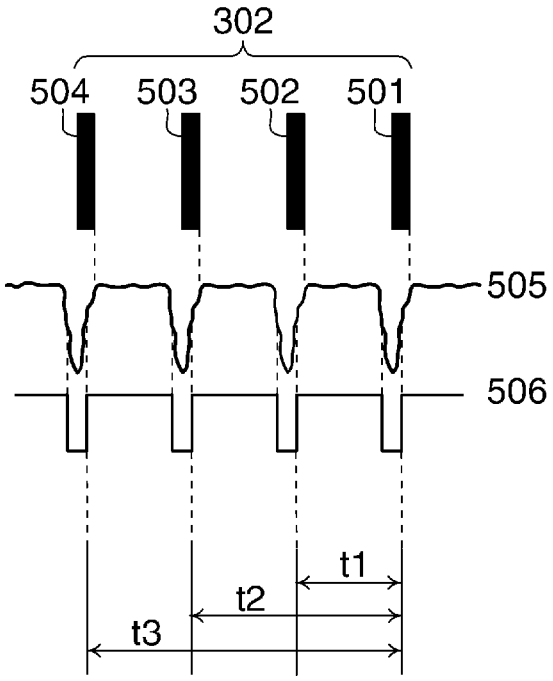
FIG. 7 is a diagram useful in explaining a process for detecting a color misregistration correction pattern.

FIG. 7 is a diagram useful in explaining a process for detecting a color misregistration correction pattern. FIG. 7 schematically shows part of the pattern group 302. To detect a color misregistration amount, the image forming section 1 forms the pattern group 302 on the intermediate transfer belt 13*a*, as shown in FIG. 6. A yellow pattern image 501 is formed by a yellow toner. A magenta pattern image 502 is formed by a magenta toner. A cyan pattern image 503 is formed by a cyan toner. A black pattern image 504 is formed by a black toner. A distance between adjacent ones of the pattern images is e.g. 12700 μm (corresponding to 300 pixels at 600 dpi). The pattern sensor 112 detects each of the pattern images 501 to 504 formed on the intermediate transfer belt 13*a*, and generates an analog signal 505. The pattern sensor 112 binarizes the analog signal 505 output from the light receiving section 303 using a comparator, to thereby convert the analog signal 505 to a detection waveform 506. The comparator performs the binarization by comparing the analog signal 505 with a threshold voltage. The threshold voltage is determined in advance in order to determine whether or not any pattern image formed by a toner exists on the intermediate transfer belt 13*a*.

The CPU 201 activates a timer/counter provided therein in order to read the detection waveform 506 output from the pattern sensor 112. The timer/counter is sequentially incremented by an internal clock of the CPU 201. The CPU 201 detects a falling edge of the detection waveform 506 via the I/O 205, converts a timer/counter value at that time to a time, and stores the time in the RAM 203. The CPU 201 calculate distances between the colors by calculating differences t1 to t3 between a detection timing of the pattern image 501 as a reference time and respective detection times of the pattern images 502 to 504, and multiplying the respective differences t1 to t3 by the conveying speed. Note that the timing may be adjusted using only the differences t1 to t3 instead of calculating the physical distances. Although the image data of the pattern images 501 to 504 is prepared such that the pattern images 501 to 504 are formed at equally-spaced intervals as mentioned above, when color misregistration is caused, the equal-interval property of the pattern images 501 to 504 is lost. If no color misregistration is caused, there hold $t1=t0$, $t2=2\times t0$, and $t3=3\times t0$. Therefore, the color misregistration amounts in the case where color misregistration occurs are $\Delta t1=t0-t1$, $\Delta t2=2\times t0-t2$, and $\Delta t3=3\times t0-t3$ (note that $t0=12700$ μm/image forming speed). Such color misregistration depends on the temperature change and component aging of the laser scanner 104, the process cartridges 101, and the intermediate transfer belt 13*a*. The CPU 201 can detect the color misregistration amounts at each of the image forming speeds.

FIGS. 8A, 8B, and 8C are diagrams showing examples of results of color misregistration detection performed at the first, second, and third speeds, respectively. A distance L1 between yellow and magenta is 12700 μm, a distance L2 between yellow and cyan is 25400 μm, and a distance L3 between yellow and black is 38100 μm.

Referring to FIG. 8A, at the first speed (300 mm/s), an ideal reading time t1 (=t0) for the pattern sensor 112 is 42333 μsec, an ideal reading time t2 ($=2\times t0$) is 84667 μsec, and an ideal reading time t3 ($=3\times t0$) is 127000 μsec. Here, let it be assumed that the times t1, t2, and t3 detected by the pattern sensor 112 are 42328 μsec, 84711 μsec, and 126973 μsec, respectively. In this case, the differences Δt1, Δt2, and Δt3 with respect to the respective ideal reading times are −5 μsec, 44 μsec, and −27 μsec, respectively. When these differences are converted to the distances at the first speed, the color misregistration amounts ΔL1, ΔL2, and ΔL3 are −2 μm, +13 μm, and −8 μm, respectively.

Similarly, results of color misregistration detection at the second speed (100 mm/s) are a color misregistration amount ΔL1'=+55 μm, a color misregistration amount ΔL2'=+79 μm, and a color misregistration amount ΔL3'=+63 μm, as shown in FIG. 8B. Results of color misregistration detection at the third speed (200 mm/s) are a color misregistration amount ΔL1"=+26 μm, a color misregistration amount ΔL2"=+46 μm, and a color misregistration amount ΔL3"=+27 μm, as shown in FIG. 8C.

Here, the color misregistration amounts ΔL1, ΔL1', and ΔL1" are the color misregistration amounts of M with reference to Y. The color misregistration amounts ΔL2, ΔL2', and ΔL2" are the color misregistration amounts of C with reference to Y. The color misregistration amounts ΔL3, ΔL3', and ΔL3" are the color misregistration amounts of K with reference to Y. Hereinafter, the color misregistration amounts ΔL1, ΔL2, and ΔL3 are sometimes collectively referred to as the color misregistration amount ΔL (first color misregistration amount) at the first speed. Similarly, the color misregistration amounts ΔL1', ΔL2', and ΔL3' are sometimes collectively referred to as the color misregistration amount ΔL' (second color misregistration amount) at the second speed, and the color misregistration amounts ΔL1", ΔL2", and ΔL3" are sometimes collectively referred to as the color misregistration amount ΔL" (third color misregistration amount) at the third speed.

In a case where image formation is performed at the first speed, the CPU 201 shifts the writing start times of images of M, C, and K from respective ideal writing start times such that the color misregistration amount ΔL at the first speed is canceled out. More specifically, the CPU 201 shifts the writing start time of M by ΔL1, that of C by ΔL2, and that of K by ΔL3. In a case where image formation is performed at the second speed, the CPU 201 shifts the writing start times of the images of M, C, and K from the respective ideal writing start times such that the color misregistration amount ΔL' at the second speed is canceled out. More specifically, the CPU 201 shifts the writing start time of M by ΔL1', that of C by ΔL2', and that of K by ΔL3'. In a case where image formation is performed at the third speed, the CPU 201 shifts the writing start times of the images of M, C, and K from the respective ideal writing start times such that the color misregistration amount ΔL" at the third speed is canceled out. More specifically, the CPU 201 shifts the writing start time of M by ΔL1", that of C by ΔL2", and that of K by ΔL3". With this, color misregistration in the sub scanning direction can be corrected with respect to all the image forming speeds.

In the above-described examples, the color misregistration amounts are individually detected at each of the first, second, and third speeds. On the other hand, color misregistration amounts at one image forming speed and color misregistration amounts at another image forming speed are sometimes correlated with each other or similar to each other. In this case, by calculating the color misregistration amounts at the one image forming speed, and correcting the calculated color misregistration amounts by the correlation, it will be possible to omit detections of the color misregistration amounts at the other image forming speed. For example, if differences of the color misregistration amounts at the other image forming speed with respect to the color misregistration amounts at the one image forming speed are calculated in advance, it is possible, by adding the differences to results of color misregistration detection at the one image forming speed, to calculate the color misregistration amounts at the other image forming speed.

FIG. 8D is a diagram of misregistration amount differences which are differences between the color misregistration amounts at the second speed and the color misregistration amounts at the first speed, and FIG. 8E is a diagram of misregistration amount differences which are differences between the color misregistration amounts at the third speed and the color misregistration amounts at the first speed. FIG. 8D shows the misregistration amount differences dL' (dL1' to dL3') (second misregistration amount differences) indicative of the differences between the color misregistration amounts ΔL at the first speed and the color misregistration amounts ΔL' at the second speed. FIG. 8E shows the misregistration amount differences dL" (dL1" to dL3") (first misregistration amount differences) indicative of the differences between the color misregistration amounts ΔL at the first speed and the color misregistration amounts ΔL" at the third speed.

The misregistration amount differences dL' (FIG. 8D) are calculated from the color misregistration amounts ΔL and the color misregistration amounts ΔL'. The misregistration amount differences dL1' to dL3' are calculated as the misregistration amount difference dL1' of M=ΔL1'−ΔL1=55−(−2)=57 μm, the misregistration amount difference dL2' of C=ΔL2'−ΔL2=66 μm, and the misregistration amount difference dL3' of K=ΔL3'−ΔL3=71 μm. On the other hand, the misregistration amount differences dL" (FIG. 8E) are calculated based on the color misregistration amounts ΔL and the color misregistration amounts ΔL' (more specifically, from the color misregistration amounts ΔL, and the misregistration amount differences dL' calculated from the color misregistration amounts ΔL and the color misregistration amounts ΔL'). That is, the misregistration amount differences dL" may well be referred to as estimated values. The misregistration amount differences dL1" to dL3" are the misregistration amount difference dL1" of M=28 μm, the misregistration amount difference dL2" of C=33 μm, and the misregistration amount difference dL3" of K=35 μm, respectively.

In the present embodiment, the CPU 201 uses the color misregistration amount ΔL as a correction amount in color misregistration correction at the first speed. On the other hand, in color misregistration correction at the second speed and color misregistration correction at the third speed, the CPU 201 uses the misregistration amount differences dL' and the misregistration amount differences dL", respectively, in addition to the color misregistration amounts ΔL at the first image forming speed. More specifically, in a case where image formation is performed at the second speed, the CPU 201 uses values obtained by adding the misregistration amount differences dL1' to dL3' to the color misregistration amounts ΔL1 to ΔL3, respectively, as correction amounts in this case. Similarly, in a case where image formation is performed at the third speed, the CPU 201 uses values obtained by adding the misregistration amount differences dL1" to dL3" to the color misregistration amounts ΔL1 to ΔL3, respectively, as correction amounts in this case. The CPU 201 corrects color misregistration by shifting the writing start times of the images of M, C, and K from the respective ideal writing start times by associated ones of the correction amounts, respectively.

Here, a description will be given of the correlation between the misregistration amount differences. The misregistration amount differences dL' and dL" are caused by slippage due to the aging of the intermediate transfer belt 13*a*. When slippage occurs due to the aging of the intermediate transfer belt 13*a*, transfer times of toner images from the photosensitive drums 102 of the respective colors to the intermediate transfer belt 13*a* deviate to cause color misregistration. It is known that the amount of slippage becomes larger as the image forming speed is lower, and the misregistration amount differences as well, which are caused by the slippage, become larger as the image forming speed is lower. That is, since the second speed is lower than the third speed, the misregistration amount differences have characteristics that the misregistration amount differences from the color misregistration amounts at the first speed are larger at the second speed, i.e. the misregistration amount difference dL"<the misregistration amount difference dL' holds.

FIGS. 9A to 9D are diagrams showing the misregistration amount differences dL' and dL" calculated when different numbers of sheets were subjected to image formation, respectively. The misregistration amount differences dL' and dL" shown in FIGS. 9A to 9D were calculated by performing misregistration detection on images of the colors when image formation was performed on 35000 sheets, 40000 sheets, 50000 sheets, and 60000 sheets, starting from when the intermediate transfer belt 13*a* was brand new.

As shown in FIG. 9A, when image formation was performed on 35000 sheets by starting to use the brand new intermediate transfer belt 13*a*, the maximum value of the misregistration amount differences dL1' to dL3' at the second speed was 20 μm (corresponding to 0.5 pixels in the case of 600 dpi). Similarly, the maximum value of the misregistration amount differences dL1" to dL3" at the third speed was 10 μm (corresponding to 0.25 pixels in the case of 600 dpi). In this case, at both the second speed and the third speed, the influence of color misregistration caused by slippage due to the aging of the intermediate transfer belt 13*a* was not noticeable. That is, for both of the second and third speeds, even when color misregistration correction is performed based on the color misregistration amounts at the first speed by omitting detection of the misregistration amount differences from the color misregistration amounts at the first speed, it causes almost no color misregistration.

Referring to FIG. 9B, when image formation was performed on 40000 sheets, the maximum value of the misregistration amount differences dL1' to dL3' was 46 μm (corresponding to one pixel in the case of 600 dpi). The maximum value of the misregistration amount differences dL1" to dL3" at the third speed was 23 μm (corresponding to 0.5 pixels in the case of 600 dpi). In this case, it is known that at the second speed, color misregistration caused by slippage due to the aging of the intermediate transfer belt 13*a* became noticeable. That is, when image formation is performed on 40000 sheets, depending on a color, the misregistration amount difference dL' can reach an amount corresponding to a positional deviation of one pixel. To solve this problem, it is required to calculate the misregistration amount differences dL' at the second speed. On the other hand, at the third speed, color misregistration caused by slippage due to the aging of the intermediate transfer belt 13*a* was not noticeable, and hence it is not required to use the misregistration amount differences dL".

Referring to FIG. 9C, when image formation was performed on 50000 sheets, the maximum value of the misregistration amount differences dL1' to dL3' was 71 μm (corresponding to 1.7 pixels in the case of 600 dpi), and the maximum value of the misregistration amount differences dL1" to dL3" was 35 μm (corresponding to 0.83 pixels in the case of 600 dpi). Although at the third speed, the misregistration amount differences dL' were increased, they correspond to positional deviations of less than one pixel, so that similar to the case where image formation was performed on 40000 sheets, color misregistration caused by slippage due to the aging of the intermediate transfer belt 13*a* remained unnoticeable.

Referring to FIG. 9D, when image formation was performed on 60000 sheets, the maximum value of the misregistration amount differences dL1' to dL3' was 110 μm (corresponding to 2.6 pixels in the case of 600 dpi), and the maximum value of the misregistration amount differences dL1" to dL3" was 55 μm (corresponding to 1.3 pixels in the case of 600 dpi). When image formation was performed on 60000 sheets from when the intermediate transfer belt 13*a* was brand new, color misregistration caused by slippage due to the aging of the intermediate transfer belt 13*a* became noticeable not only at the second speed but also at the third speed. Therefore, it is required to calculate the misregistration amount differences dL' and dL" for both the second speed and the third speeds.

Incidentally, as is clear from FIGS. 9A to 9D, the misregistration amount differences dL1' to dL3' at the second speed were always larger than the misregistration amount differences dL1" to dL3" at the third speed. This is because the amount of slippage due to the aging of the intermediate transfer belt 13*a* has characteristics that the amount of slippage becomes larger as the image forming speed is lower. There is a correlation between the misregistration amount differences dL' at the second speed and the misregistration amount differences dL" at the third speed, irrespective of the number of sheets subjected to image formation, and generally, the following correlational relationships hold:

$$dL1''=dL1'\div 2$$

$$dL2''=dL2'\div 2$$

$$dL3''=dL3'\div 2$$

To summarize these correlational relationships, they are expressed by an equation of dL"=dL'÷2, and this equation is stored in advance e.g. in the ROM 202. Here, the value of 2 corresponds to a coefficient determined from the second and third speeds. In the present embodiment, the second speed is 100 mm/s, and the third speed is 200 mm/s. The coefficient is calculated by an equation of the coefficient=the second speed÷the third speed, and turns out to be equal to a value of "2" which is approximately the same as the speed ratio. Although the coefficient is changed depending on settings of the second speed and the third speed, it is only required to store an equation determined by acquiring data according to the settings of the second speed and the third speed in advance.

The misregistration amount differences dL" at the third speed can be calculated based on the color misregistration amounts ΔL and the color misregistration amounts ΔL' by using the above-mentioned equation, without being calculated based on the detected color misregistration amounts ΔL and ΔL". Similarly, the misregistration amount differences dL' at the second speed can also be calculated based on the color misregistration amounts ΔL and ΔL" by using the above-mentioned equation, without being calculated based on the detected color misregistration amounts ΔL and ΔL'. Although in the present embodiment, the CPU 201 calculates the misregistration amount differences dL' based on the color misregistration amounts ΔL and ΔL', the CPU 201 calculates the misregistration amount differences dL" based on the color misregistration amounts ΔL and ΔL' using the above-mentioned equation. Since the CPU 201 calculates and estimates the misregistration amount differences dL" without detecting the color misregistration amounts ΔL", processing is simplified.

Figure 10:
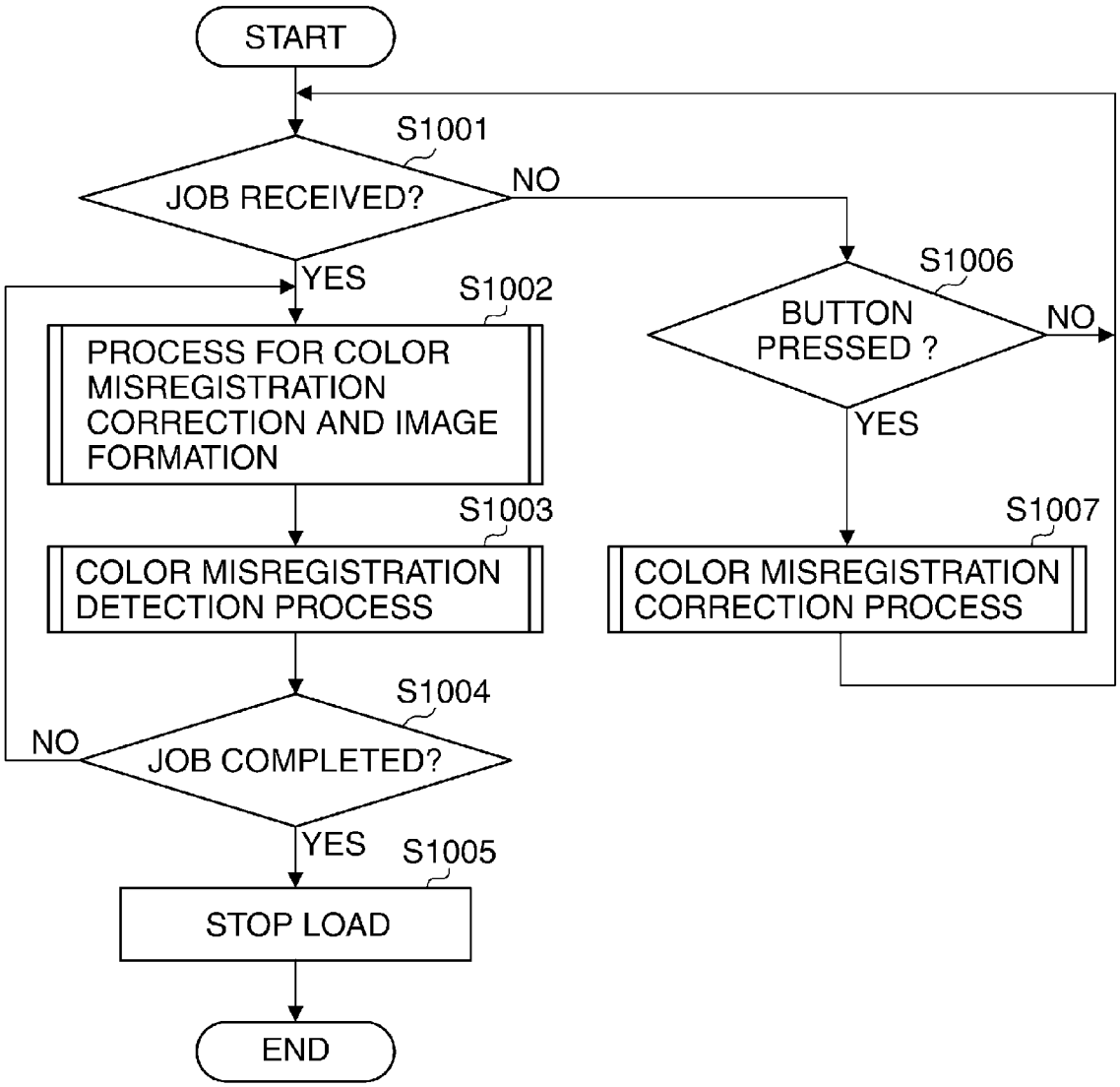
FIG. 10 is a flowchart of an image forming job control process.

FIG. 10 is a flowchart of an image forming job control process. The image forming job control process is realized by the CPU 201 which reads out a program stored in the ROM 202 and executes the same. This process is started when the apparatus is powered on. The CPU 202 plays the roles of a controller, a generation unit, and a correction unit in the present invention. First, in a step S1001, the CPU 201 determines whether or not an instruction for executing a print job has been received from the console section 220 or a host computer. If an instruction for executing a print job has not been received, the CPU 201 proceeds to a step S1006. In the step S1006, the CPU 201 determines whether or not the start button (FIG. 3C) of the console section 220, for instructing the start of color misregistration correction has been pressed. If the start button has not been pressed, the process returns to the step S1001. If the start button has been pressed, the CPU 201 proceeds to a step S1007, wherein the CPU performs a color misregistration detection process which is described in detail with reference to FIG. 11. With this, the color misregistration correction is performed at a time desired by an operator. Then, the process returns to the step S1001.

In the step S1001, if an instruction for executing a print job has been received, the CPU 201 proceeds to a step S1002. In the step S1002, the CPU 201 performs a process for color misregistration correction and image formation, which is described in detail with reference to FIG. 12. In a step S1003, the CPU 201 performs the color misregistration detection process shown in FIG. 11, which is executed after execution of image formation in the step 1002. In a step S1004, the CPU 201 determines whether or not the print job has been completed. For example, assuming that the print job is for forming e.g. ten images on respective sheets, the CPU 201 determines whether or not image formation of all the ten images on the respective sheets has been completed. If the image formation has not been completed, the process returns to the step S1002, whereas if the image formation has been completed, the CPU 201 proceeds to a step S1005, wherein the CPU 201 stops all loads (the fixing device, the rollers, etc.) involved in the image formation, in order to shift the image formation mode to a standby mode.

Figure 11:
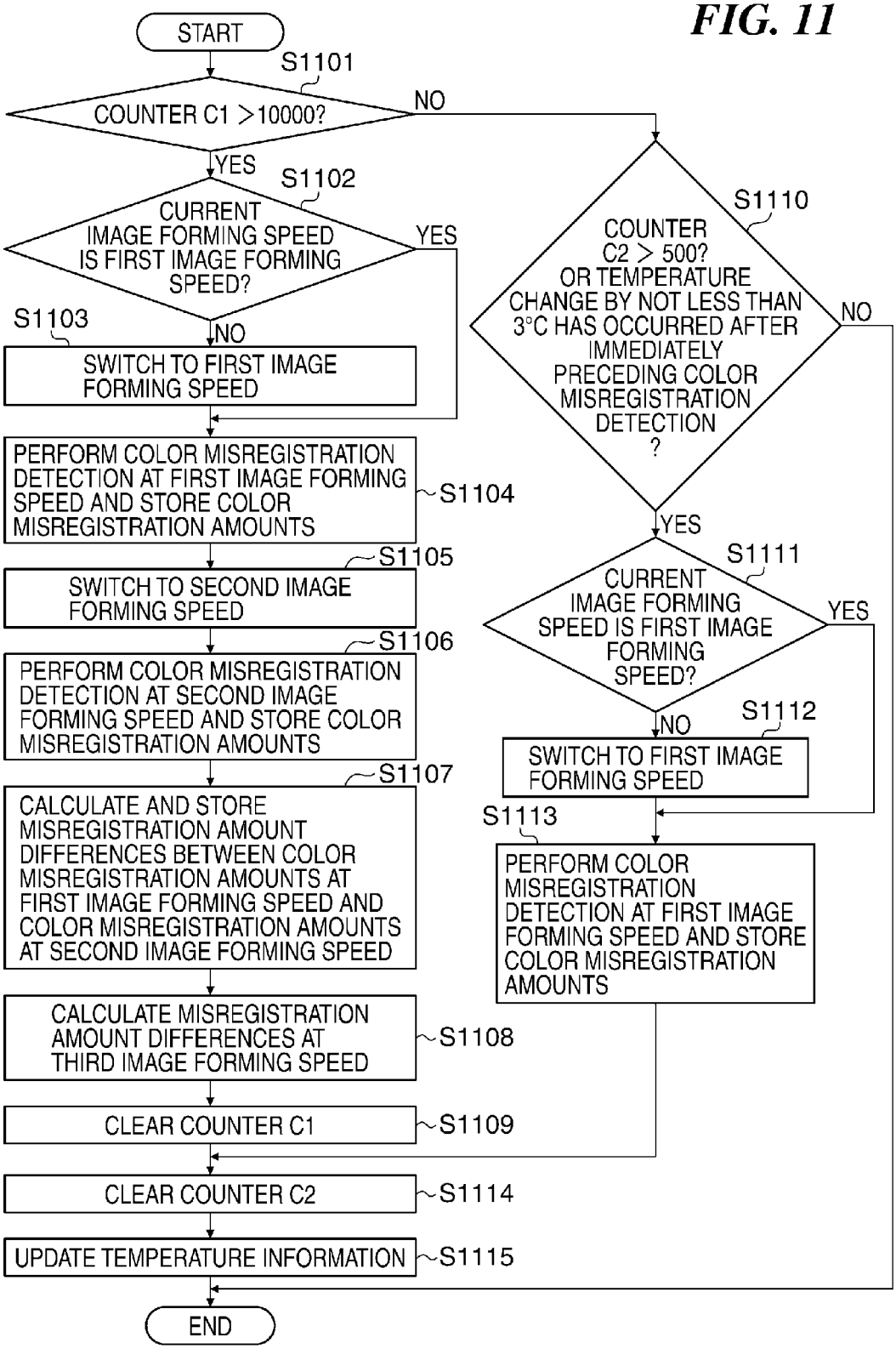
FIG. 11 is a flowchart of a color misregistration detection process.

FIG. 11 is a flowchart of the color misregistration detection process. The CPU 201 performs the color misregistration detection process in the step S1006 in FIG. 10 when a user's instruction is given, and in the step S1003 in FIG. 10 whenever image formation on one sheet is terminated.

First, a description will be given of an outline of the color misregistration detection process in FIG. 11. In steps S1111 to S1113 in FIG. 11, a first detection operation is performed for detecting, by using the first speed, positional deviations of images of the colors other than the reference color from an image of the reference color, as the color misregistration amounts ΔL at the first speed. Timing in which the steps S1111 to S1113 are executed is first timing. Further, in addition to the first detection operation, in steps S1102 to S1106, a second detection operation is performed for detecting, by using the second speed, positional deviations as the color misregistration amounts ΔL' at the second speed. Timing in which the steps S1102 to S1106 are executed is second timing.

In the first timing, the first detection operation, i.e. a single color misregistration detection is performed at the first speed which is the highest speed. In the second timing, a set color misregistration detection is performed at two speeds, i.e. the first speed and the second speed which is the lowest speed. Since a color misregistration detection time period can be made shorter as the image forming speed is higher, in the present embodiment, the frequency of detection of the color misregistration amounts at the first speed which is the highest is made higher. This makes it possible to efficiently correct color misregistration caused by short-term factors at each image forming speed. However, to correct color misregistration caused by long-term factors, it is required to update the above-described misregistration amount differences for use in the calculation of the correction amounts, since a specific correlation between the image forming speeds is sometimes changed. Therefore, it is required to perform detection of the color misregistration amounts at the second speed by executing the aforementioned set color misregistration detection though the frequency thereof is low. Further, the misregistration amount differences dL" at the third speed can be estimated by calculation from the color misregistration amounts (ΔL and ΔL') at the first speed and the second speed, as described above, and hence there is no need to perform detection of the color misregistration amounts ΔL" at the third speed for comparison with the color misregistration amounts ΔL at the first speed.

The NVRAM 204 is provided with a counter C1 and a counter C2. In a step S1101, the CPU 201 determines whether or not the counter C1 exceeds a threshold value Th1 (e.g. 10000) (whether or not C1>Th1 holds). The value of 10000 is a value set in advance such that the color misregistration caused by long-term factors is prevented from becoming equal to or larger than one pixel (values sufficiently smaller than 40000 sheets shown in FIG. 9B). If it is determined in the step S1101 that the counter C1 exceeds 10000, there is a possibility that at least one of the misregistration amount differences dL' and dL" has become so large as to make color misregistration noticeable. To cope with this possibility, the CPU 201 determines that the set color misregistration detection in the second timing should be performed, and proceeds to the step S1102.

In the step S1102, the CPU 201 determines whether or not the current image forming speed is the first speed. If the current image forming speed is the first speed, the CPU 201 proceeds to a step S1104. On the other hand, if the current image forming speed is not the first speed, the CPU 201 switches the image forming speed to the first speed (step S1103), and then proceeds to the step S1104. Note that the image forming speed is switched according to an instruction given by the CPU 201 to the motor driver 208 and the like. In response to the instruction, the motor driver 208 and the like adjust the rotational speed of the motors such that the current image forming speed is switched to a target image forming speed. In the step S1104, the CPU 201 performs color misregistration detection at the first speed, and stores the color misregistration amounts ΔL1 to ΔL3 as results of the color misregistration detection in the RAM 203. A pattern group 302 formed in the step S1104 is particularly referred to as the "first images for detection". After storage of the color misregistration amounts ΔL1 to ΔL3, the CPU 201 switches the image forming speed to the second speed (step S1105), and performs color misregistration detection at the second speed. Then, the CPU 201 stores the color misregistration amounts ΔL1' to ΔL3' as results of the color misregistration detection in the RAM 203 (step S1106). A pattern group 302 formed in the step S1106 is particularly referred to as the "second images for detection".

In the step S1107, the CPU 201 calculates the misregistration amount differences dL1' to dL3' at the second speed by subtracting the color misregistration amounts ΔL1 to ΔL3 at the first speed from the color misregistration amounts ΔL1' to ΔL3' at the second speed, respectively. Then, the CPU 201 stores the calculated misregistration amount differences dL1' to dL3' in the RAM 203. Next, the CPU 201 calculates the misregistration amount differences dL1" to dL3" at the third speed from the misregistration amount differences dL1' to dL3' stored in the RAM 203, using the above-mentioned equation (step S1108). For example, in a case where the misregistration amount difference dL1' is 92 μm, the misregistration amount difference dL1" is calculated as 92÷2=46 μm. The CPU 201 stores the calculated misregistration amount differences dL1" to dL3" in the RAM 203. Then, the CPU 201 clears the counter C1 (step S1109), and clears the counter C2 as well (step S1114). Next, the CPU 201 updates temperature information X at the time of execution of the color misregistration detection, which is stored in the RAM 203, to the current temperature Xc detected by the thermistor 50 (step S1115), followed by terminating the color misregistration detection process in FIG. 11.

On the other hand, in the step S1101, if the counter C1 is not larger than 10000, the CPU 201 determines that there is no need to perform the set color misregistration detection, and proceeds to a step S1110. In the step S1110, the CPU 201 determines whether or not the first timing has come. More specifically, in a case where the number of sheets subjected to image formation after the immediately preceding execution of the first detection operation (including the execution of the set color misregistration detection) (the value of the counter C2) exceeds a threshold value Th2 (second threshold value) (e.g. 500 sheets), it is determined that the first timing has come. Alternatively, in a case where a temperature change of not smaller than a threshold value Th3 (higher than a predetermined temperature) has occurred after the immediately preceding execution of the color misregistration detection, as well, it is determined that the first timing has come. The threshold value Th3 is set to e.g. 3° C. Therefore, the CPU 201 determines at least whether C2>Th2 holds or a difference between the current temperature Xc and the temperature X stored in the RAM 203 is not smaller than the threshold value Th3 (|Xc−X|≥Th3 holds). Then, if C2>Th2 or |Xc−X|≥Th3 holds, the CPU 201 determines that the first timing has come, and proceeds to the step S1111. On the other hand, if neither C2>Th2 nor |Xc−X|≥Th3 holds, the CPU 201 terminates the color misregistration detection process in FIG. 11.

In the step S1111, the CPU 201 determines whether or not the current image forming speed is the first speed. If the current image forming speed is the first speed, the CPU 201 proceeds to the step S1113, whereas if the current image forming speed is not the first speed, the CPU 201 switches the image forming speed to the first speed (step S1112), and then proceeds to the step S1113. In the step S1113, the CPU 201 performs color misregistration detection at the first speed, and stores the color misregistration amounts ΔL1 to ΔL3 as results of the color misregistration detection in the RAM 203. Then, the CPU 201 proceeds to the step S1114. Note that although the misregistration amount differences dL' and dL" are updated as required after starting to use the image forming apparatus, predetermined values are stored in the NVRAM 204 as the misregistration amount differences dL' and dL" before shipping the image forming apparatus.

Figure 12:
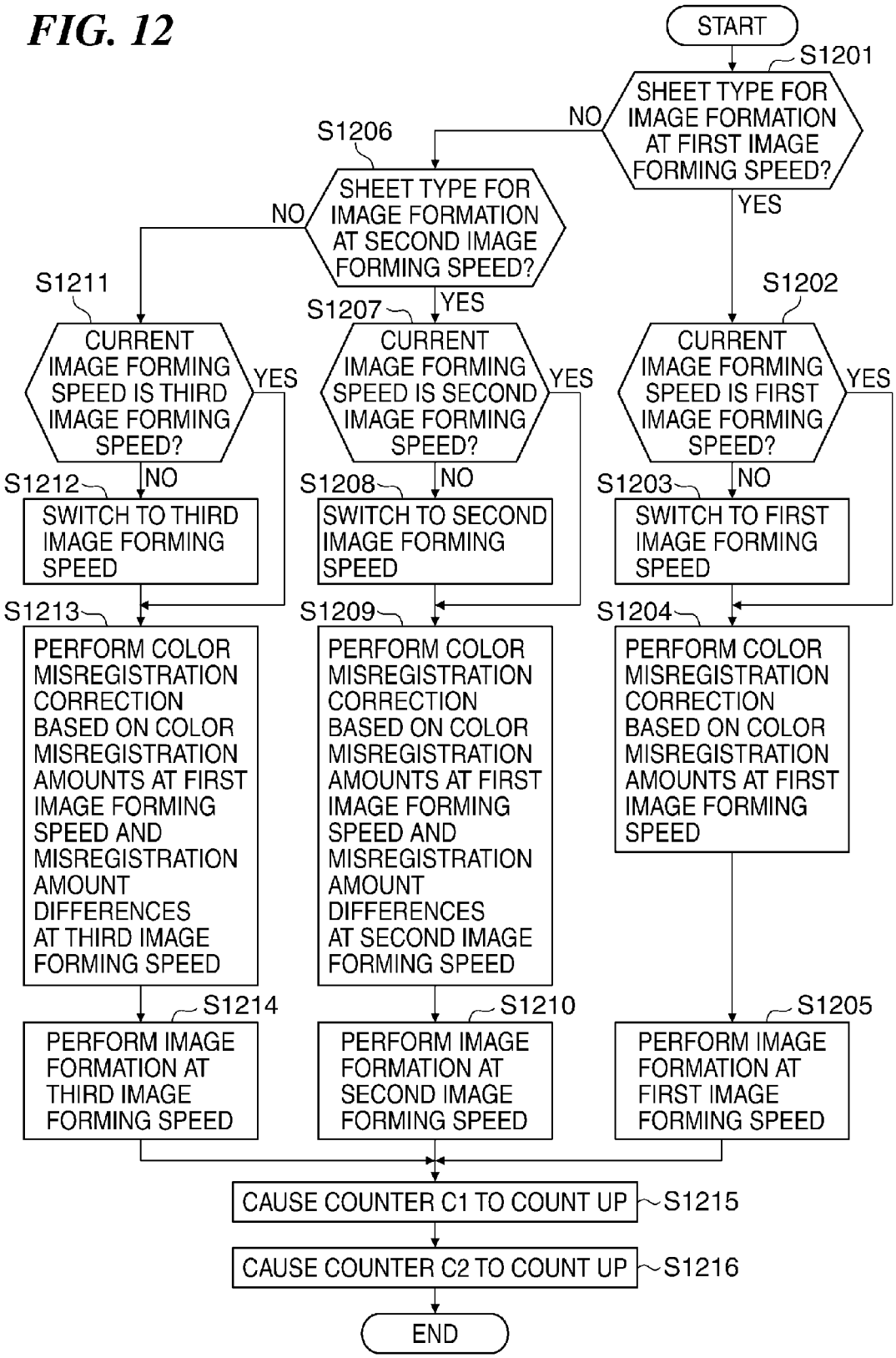
FIG. 12 is a flowchart of a process for color misregistration correction and image formation.

FIG. 12 is a flowchart of the process for color misregistration correction and image formation. The process for color misregistration correction and image formation is executed in the step S1002 in FIG. 10. Therefore, the CPU 201 performs the FIG. 12 process for color misregistration correction and image formation, on a sheet-by-sheet basis, to thereby perform image forming operation while performing color misregistration correction.

First, in a step S1201, the CPU 201 determines whether or not a sheet type of sheets S designated by the print job as an image formation target is a sheet type of sheets on which image formation is to be performed at the first speed. The CPU 201 stores a table showing a correspondence between the sheet types and the image forming speeds shown in FIG. 4, in the ROM 202. Therefore, the CPU 201 searches the table according to the sheet type designated by the print job, and acquires an image forming speed associated with the designated sheet type. If the designated sheet type of sheets S is a sheet type of sheets on which the image formation is to be performed at the first speed, the CPU 201 proceeds to a step S1202. In the step S1202, the CPU 201 determines whether or not the current image forming speed set in the image forming section 1 is the first speed. If the current image forming speed is the first speed, the CPU 201 proceeds to a step S1204, whereas if the current image forming speed is not the first speed, the CPU 201 switches the image forming speed set in the image forming section 1 to the first speed (step S1203), and then proceeds to the step S2004. In the step S2004, the CPU 201 performs color misregistration correction based on the color misregistration amounts ΔL1 to ΔL3 at the first speed. The CPU 201 uses the color misregistration amounts ΔL1 to ΔL3 as correction amounts to shift the writing start times of the images of the associated colors by respective associated ones of the correction amounts. In a step S1205, the CPU 201 controls the image forming section 1 to perform image forming operations at the first speed, and proceeds to a step S1215.

On the other hand, in the step S1201, if the designated sheet type of sheets S is not a sheet type of sheets on which the image formation is to be performed at the first speed, the CPU 201 proceeds to a step S1206. In the step S1206, the CPU 201 determines whether or not the designated sheet type of sheets S as the image formation target is a sheet type of sheets on which image formation is to be performed at the second speed. If the designated sheet type of sheets S is a sheet type of sheets on which the image formation is to be performed at the second speed, the CPU 201 determines whether or not the current image forming speed set in the image forming section 1 is the second speed (step S1207). If the current image forming speed is the second speed, the CPU 201 proceeds to a step S1209, whereas if the current image forming speed is not the second speed, the CPU 201 switches the image forming speed set in the image forming section 1 to the second speed in a step S1208, and then proceeds to the step S1209.

In the step S1209, the CPU 201 performs color misregistration correction based on the color misregistration amounts ΔL1 to ΔL3 at the first speed and the misregistration amount differences dL1' to dL3'. For example, the CPU 201 calculates the correction amount of the writing start time of a magenta image at the second speed by adding the misregistration amount difference dL1' to the color misregistration amount ΔL1. The same calculation can also be applied to images of the other colors. The CPU 201 shifts the writing start times of the images of the associated colors by associated ones of the correction amounts. Next, in a step S1210, the CPU 201 controls the image forming section 1 to perform image forming operations at the second speed, and then proceeds to the step S1215.

On the other hand, in the step S1206, if the designated sheet type of sheets S is not a sheet type of sheets on which the image formation is to be performed at the second speed, the CPU 201 proceeds to a step S1211. In the step S1211, the CPU 201 determines whether or not the current image forming speed is the third speed. If the current image forming speed is the third speed, the CPU 201 proceeds to a step S1213, whereas if the current image forming speed is not the third speed, the CPU 201 switches the image forming speed to the third speed (step S1212), and the proceeds to the step S1213. In the step S1213, the CPU 201 performs color misregistration correction based on the color misregistration amounts ΔL1 to ΔL3 at the first speed and the misregistration amount differences dL1" to dL3". For example, the CPU 201 calculates the correction amount of the writing start time of the magenta image at the third speed by adding the misregistration amount difference dL1" to the color misregistration amount ΔL1. The same calculation can also be applied to the images of the other colors. Next, in a step S1214, the CPU 201 controls the image forming section 1 to perform image forming operations at the third speed, and then proceeds to the step S1215. The CPU 201 causes the first counter C1 to count up by one in the step S1215, and the second counter C2 to count up by one in a step S1216, followed by terminating the FIG. 12 process for color misregistration correction and image formation.

According to the present embodiment, first, the single first detection operation, and the set color misregistration detection including the second detection operation are selectively performed. This makes it possible to correct color misregistration caused by short-term factors and color misregistration caused by long-term factors in proper timing, and thereby efficiently prevent occurrence of color misregistration at all the image forming speeds. More specifically, when the number of sheets subjected to image formation after the immediately preceding execution of the first detection operation exceeds the threshold value Th2 (500), the first timing comes, and the first detection operation is performed. When the number of sheets subjected to image formation from when the second timing came last time exceeds the threshold value Th1 (10000), the second timing comes, so that the first and second detection operations and the misregistration amount difference calculation operations are performed. Here, since the threshold value Th1 is larger than the threshold value Th2, while it is possible to enhance the accuracy of the color misregistration correction by correcting the color misregistration caused by the short-term factors with a higher frequency, it is possible to reduce downtime by correcting the color misregistration caused by the long-term factors with a lower frequency.

Further, in a case where the color misregistration amounts ΔL at the first speed and the color misregistration amounts ΔL' at the second speed are detected, the misregistration amount differences dL" are calculated based on the color misregistration amounts ΔL and ΔL' through calculation of the misregistration amount differences dL' (S1108). To calculate the misregistration amount differences dL", it is not required to perform detection of the color misregistration amounts ΔL" at the third speed for comparison with the color misregistration amounts ΔL at the first speed, and hence it is possible to avoid occurrence of downtime. This makes it possible to perform correction of respective amounts of color misregistration occurring with the image forming speeds while reducing downtime.

Further, when the difference between the current temperature and the temperature at the time of the immediately preceding execution of the first detection operation is not smaller than the threshold value Th3 (3° C.), the first timing comes. This makes it possible to perform image formation while suppressing color misregistration according to a change in the internal temperature of the image formatting apparatus. Note that the first timing comes not only when the internal temperature of the image formatting apparatus has changed but also when the number of sheets subjected to image formation exceeds the threshold value Th2 (500) because there is a case where a temperature detected by the thermistor 50 does not follow up a change in the temperature of the laser scanner 104 which is a cause of color misregistration.

Note that the threshold value Th1 (10000) is sufficiently smaller than the number of sheets subjected to image formation (approximately 40000 sheets) at which the misregistration amount differences dL' is assumed to reach an amount corresponding to a positional deviation of one pixel. This makes it possible to perform the first and second detection operations sufficiently before occurrence of the positional deviation of one pixel.

Figure 13A:
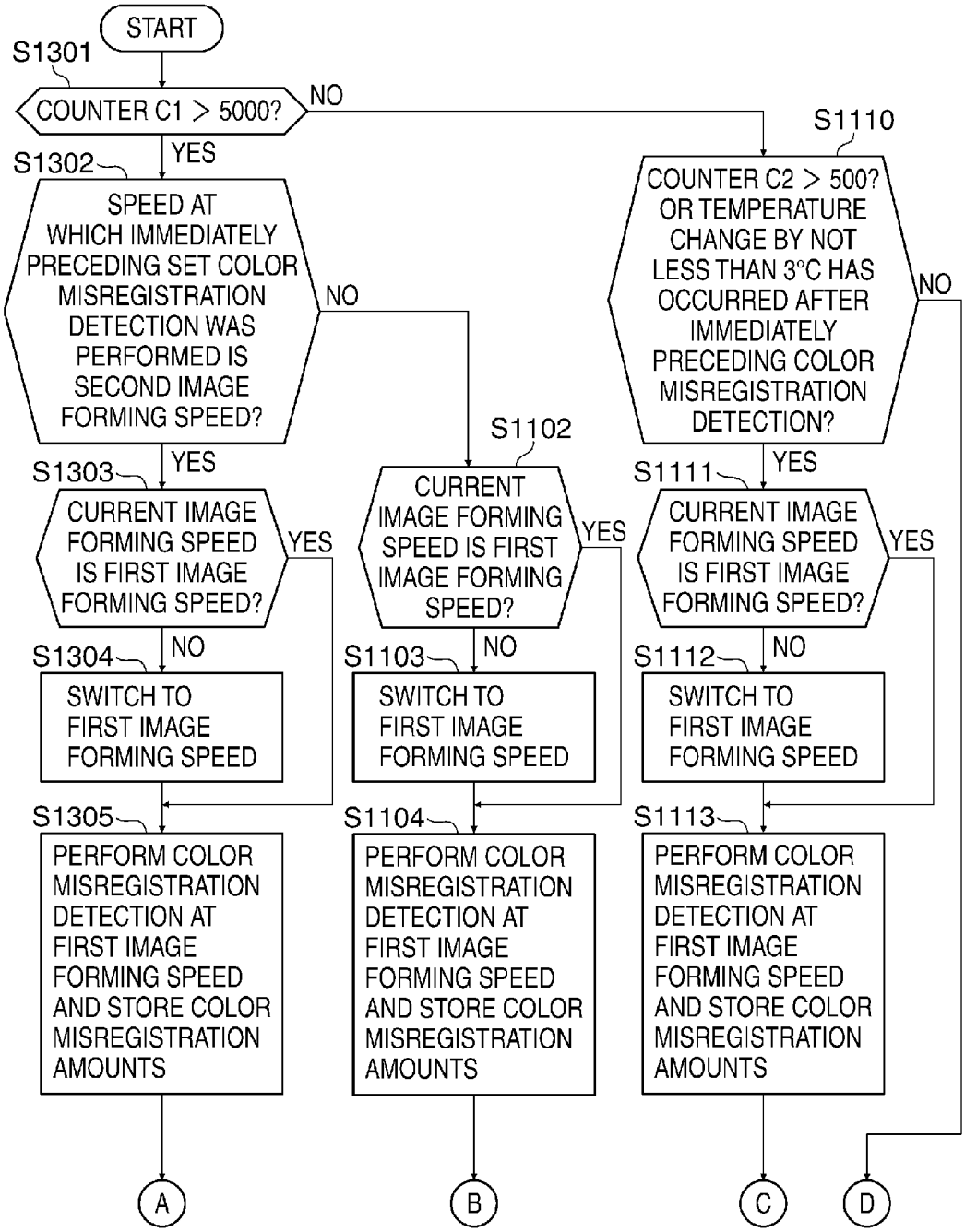
FIGS. 13A and 13B are a flowchart of a color misregistration detection process performed by an image forming apparatus according to a second embodiment of the invention.
Figure 13B:
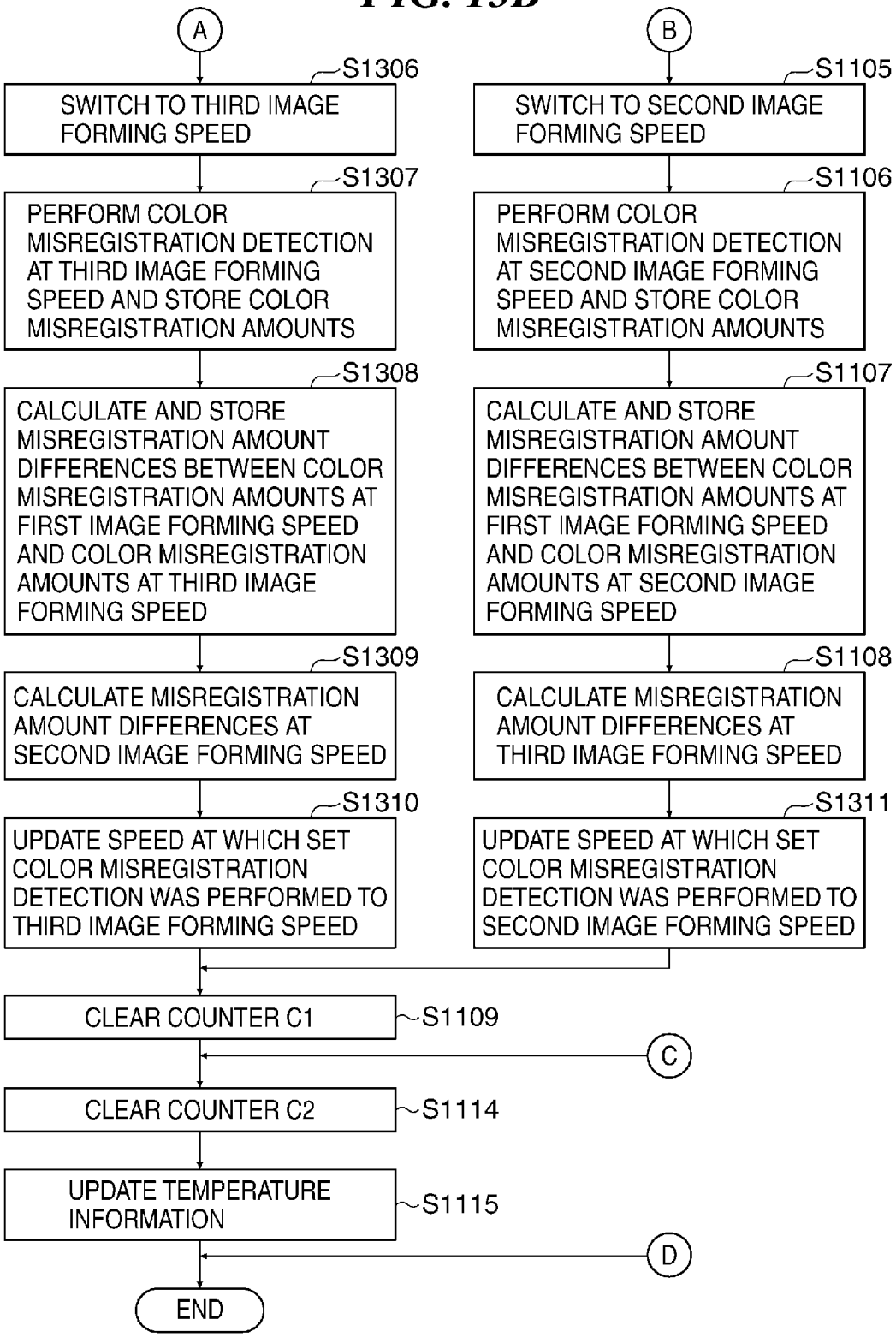

Next, a second embodiment of the present invention will be described. Although the first embodiment is configured such that the misregistration amount differences dL" are estimated by calculation based on the color misregistration amounts ΔL and ΔL', the misregistration amount differences dL' (dL1' to dL3') (second misregistration amount differences) can be estimated inversely by calculation based on the color misregistration amounts ΔL at the first speed and the color misregistration amounts ΔL" at the third speed. To this end, in the second embodiment, a step of estimating the misregistration amount differences dL' by calculation based on the color misregistration amounts ΔL and ΔL" is added to the color misregistration detection process. Therefore, in the present embodiment, a color misregistration detection process shown in FIGS. 13A and 13B is performed in place of the color misregistration detection process in FIG. 11. The other configuration than the above is the same as that according to the first embodiment.

FIGS. 13A and 13B are a flowchart of the color misregistration detection process in the second embodiment. The CPU 201 performs the color misregistration detection process in the step S1006 in FIG. 10 when a user's instruction is given, and in the step S1003 in FIG. 10 whenever image formation on one sheet is terminated. The color misregistration detection process in FIGS. 13A and 13B is distinguished from the color misregistration detection process in FIG. 11 in that the step S1101 is replaced by a step S1301, and steps S1302 to S1311 are newly added.

First, a description will be given of an outline of the color misregistration detection process in FIGS. 13A and 13B. In steps S1303 to S1307, in addition to the first detection operation, a third detection operation is performed for detecting positional deviations at the third speed, as the color misregistration amounts ΔL" at the third speed. Timing in which the steps S1303 to S1307 are executed is third timing. More specifically, in the third timing, color misregistration detection at the first speed and the third speed (set color misregistration detection) is performed. In the present embodiment, the second timing and the third timing alternately come. Alternately changing the combination of image forming speeds in the set color misregistration detection aims to suppress a discrepancy between results of actual color misregistration detection and predicted color misregistration detection by calculation, which could not be prevented by only one of the combinations.

In the step S1301, the CPU 201 determines whether or not the counter C1 exceeds a threshold value Th4 (C1>Th4) (fourth threshold value) (e.g. 5000). If the counter C1 is not larger than 5000, the CPU 201 determines that it is not required to perform the set color misregistration detection, and proceeds to the step S1110. The steps S1110 to S1113 are the same as those described with reference to FIG. 11. On the other hand, in the step S1301, if the counter C1 exceeds 5000, there is a possibility that at least one of the misregistration amount differences dL' and dL" has become so large as to make color misregistration noticeable. To cope with this possibility, the CPU 201 determines that one of the two types of set color misregistration detection should be performed, and proceeds to the step S1302.

Note that as described in the first embodiment, it is required to perform the set color misregistration detection at such time intervals as will prevent color misregistration caused by long-term factors from becoming equal to or larger than one pixel, and to this end, the threshold value is set to 10000 (first threshold value). In the present embodiment, the two types of set color misregistration detection are alternately performed, and hence in order that the same set color misregistration detection is performed at time intervals of 10000, the fourth threshold value is set to 5000, i.e. a half of 10000. Note that the first threshold value and the fourth threshold value may be made equal to each other e.g. by setting the first threshold value to a value not larger than 5000.

A speed S1 is set in the NVRAM 204 as information indicative of an image forming speed which was combined with the first speed in the immediately preceding set color misregistration detection. In the step S1302, the CPU 201 determines whether or not the speed S1 indicates the second speed. If it is determined that the speed S1 indicates the second speed, the image forming speed which was combined with the first speed in the immediately preceding set color misregistration detection is the second speed out of the second and third speeds, so that to employ the third speed this time, the CPU 201 proceeds to the step S1303. On the other hand, if the speed S1 does not indicate the second speed, the second speed is not employed in the immediately preceding set color misregistration detection, and therefore to employ the second speed this time, the CPU 201 proceeds to the step S1102. Note that the initial value of the speed S1 is set to a value which is neither the second speed nor the third speed. Therefore, when the step S1302 is executed for the first time, the steps S1102 et seq. are executed since the speed S1 indicates a value other than the second speed.

The steps S1102 to S1108 are the same as those described with reference to FIG. 11. The CPU 201 performs the first and second detection operations and the misregistration amount difference calculation operations, and then proceeds to the step S1311. In the step S1311, the CPU 201 sets the speed S1 to a value indicating the second speed, and stores the resulting speed S1 in the NVRAM 204. After that, the CPU 201 proceeds to the step S1109.

In the step S1303, the CPU 201 determines whether or not the current image forming speed is the first speed. If the current image forming speed is the first speed, the CPU 201 proceeds to a step S1305. On the other hand, if the current image forming speed is not the first speed, the CPU 201 switches the image forming speed to the first speed (step S1304), and then proceeds to the step S1305. In the step S1305, the CPU 201 performs color misregistration detection at the first speed, and stores color misregistration amounts ΔL1 to ΔL3 as results of the detection in the RAM 203. Then, the CPU 201 switches the image forming speed to the third speed (step S1306), performs color misregistration detection at the third speed, and stores color misregistration amounts ΔL1" to ΔL3" as results of the detections in the RAM 203 (step S1307). A pattern group 302 formed in the step S1307 is particularly referred to as the "third images for detection".

In the step S1308, the CPU 201 calculates the misregistration amount differences dL1" to dL3" at the third speed by subtracting the color misregistration amounts ΔL1 to ΔL3 at the first speed from the color misregistration amounts ΔL1" to ΔL3" at the third speed, respectively. Then, the CPU 201 stores the calculated misregistration amount differences dL1" to dL3" in the RAM 203. Next, the CPU 201 calculates the misregistration amount differences dL1' to dL3' at the second speed from the misregistration amount differences dL1" to dL3" stored in the RAM 203, using the above-mentioned equation (step S1309). For example, in a case where the misregistration amount difference dL1" is 29 μm, the misregistration amount difference dL1' is calculated as 29×2=58 μm. The CPU 201 stores the calculated misregistration amount differences dL1' to dL3' in the RAM 203. Then, in the step S1310, the CPU 201 sets the speed S1 to a value indicating the third speed, and stores the resulting speed S1 in the NVRAM 204. After that, the CPU 201 proceeds to the step S1109. The step S1109, the step S1114, and the step S1115 following the step S1310 are the same as those described with reference to FIG. 11.

According to the present embodiment, in a case where the color misregistration amounts ΔL at the first speed and the color misregistration amounts ΔL" at the third speed are detected, the misregistration amount differences dL' are calculated based on the color misregistration amounts ΔL and ΔL" by calculating the misregistration amount differences dL" (S1309). To calculate the misregistration amount differences dL', it is not required to perform detection of the color misregistration amounts ΔL' at the second speed for comparison with the color misregistration amounts ΔL at the first speed, and hence it is possible to avoid occurrence of downtime. This makes it possible to perform color misregistration correction using the respective image forming speeds while reducing downtime, whereby it is possible to obtain the same advantageous effects as provided by the first embodiment.

Further, the second timing and the third timing alternately come whenever the number of sheets subjected to image formation from when the second or third timing came last time exceeds the fourth threshold value (Th4). This prevents the set color misregistration detection in the second or third detection operation from being continuously executed, so that it is possible to avoid improper correction of the color misregistration at the second or third speed while reducing downtime.

Further, after starting to use the image forming apparatus, a first occurrence of the second timing comes before a first occurrence of the third timing, and hence the set color misregistration detection including the slowest second speed is performed first. This makes it possible to prevent color misregistration at the start of using the image forming apparatus from becoming too large.

Conventionally, color misregistration amounts are detected using a single image forming speed, and results of the detection are used to correct color misregistration for a plurality of image forming speeds. This is because color misregistration amounts caused by short-term factors, such as a change in the temperature, do not depend on the image forming speeds. On the other hand, in a case where an intermediate transfer member which is rotated by a frictional force between the same and a roller is employed as an image bearing member, as in the case of the intermediate transfer belt 13*a*, color misregistration amounts caused by long-term factors becomes noticeable. Such color misregistration amounts caused by long-term factors sometimes tend to be different between the image forming speeds. Therefore, in the first embodiment, the misregistration amount differences at the third speed are predicted (estimated) from the color misregistration amounts at the first speed and the second speed, and are used for the color misregistration correction control, whereby it is also possible to properly correct color misregistration at the image forming speeds other than the first speed. Further, in the second embodiment, it is possible not only to predict the misregistration amount differences at the third speed from the color misregistration amounts at the first speed and the second speed but also to predict the misregistration amount differences at the second speed from the color misregistration amounts at the first speed and the third speed. Further, by alternately performing the two types of the above prediction, it is possible to efficiently perform color misregistration correction with higher accuracy.

Note that in the above-described embodiments, the equations may be corrected according to the number of sheets subjected to image formation and results of detection. Further, the image bearing member may be an intermediate transfer member driven by a frictional force. Particularly, the intermediate transfer member may be the intermediate transfer belt 13*a* driven by the drive roller 13*b*. This is because the intermediate transfer belt 13*a* is driven for rotation by a frictional force acting between the same and the drive roller 13*b*, and as the intermediate transfer belt 13*a* is aged, slippage occurs to make the amount of color misregistration liable to change. Note that the values as the threshold values Th1 to Th4 are only described by way of example, and are determined in advance according to the model or the specifications of the image forming apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-128603 filed Jun. 29, 2016 which is hereby incorporated by reference herein in its entirety.

What is claimed is:

1. An image forming apparatus comprising:

a plurality of image forming units configured to form images each having a different color;

an intermediate transfer member onto which the images formed by the plurality of image forming units are transferred;

a detection unit configured to detect a color pattern formed on the intermediate transfer member, the color pattern being used for detecting color misregistration;

a controller configured to control the plurality of image forming units to form a plurality of first color patterns having different colors at a first image forming speed on the intermediate transfer member, control the detection unit to detect first color misregistration amounts, control the plurality of image forming units to form a plurality of second color patterns having the different colors at a second image forming speed different from the first image forming speed on the intermediate transfer member, and control the detection unit to detect second color misregistration amounts;

a generation unit configured to generate first correlation data based on the first color misregistration amounts and the second color misregistration amounts, and generate second correlation data based on the first correlation data; and a correction unit configured to correct an image formation position based on the first color misregistration amounts in a case where the image forming units form images at the first image forming speed, correct the image formation position based on the first color misregistration amounts and the first correlation data generated by the generation unit in a case where the image forming units form images at the second image forming speed, and correct the image formation position based on the first color misregistration amounts and the second correlation data generated by the generation unit in a case where the image forming units form images at a third image forming speed, wherein the third image forming speed is different from the first image forming speed, and wherein the third image forming speed is different from the second image forming speed.

2. The image forming apparatus according to claim 1, wherein in a case where a first condition is satisfied, the controller controls the plurality of image forming units to form the plurality of first color patterns at the first image forming speed, and wherein in a case where a second condition different from the first condition is satisfied, the controller controls the plurality of image forming units to form the plurality of first color patterns at the first image forming speed and form the plurality of second color patterns at the second image forming speed.

3. The image forming apparatus according to claim 2, further comprising a counter configured to count the number of sheets on which the images are formed, and wherein the second condition is satisfied in a case where the number counted by the counter reaches a predetermined number.

4. The image forming apparatus according to claim 3, wherein the first condition is satisfied in a case where the number counted by the counter reaches another predetermined number not larger than the predetermined number.

5. The image forming apparatus according to claim 2, further comprising a temperature detection unit configured to detect a temperature within the image forming apparatus, and wherein the first condition is satisfied in a case where a difference between a current temperature detected by the temperature detection unit and a temperature stored in advance is larger than a predetermined temperature.

6. The image forming apparatus according to claim 2, wherein in a case where a third condition is satisfied, the controller controls the plurality of image forming units to form the plurality of first color patterns at the first image forming speed, controls the detection unit to detect the first misregistration amounts, controls the plurality of image forming units to form a plurality of third color patterns at the third image forming speed, and controls the detection unit to detect the third misregistration amounts, and wherein the generation unit generates the first correlation data based on the first color misregistration amounts and the third color misregistration amounts.

7. The image forming apparatus according to claim 1, wherein the generation unit generates the second correlation data, based on the first color misregistration amounts, the second color misregistration amounts, the second image forming speed, and the third image forming speed.

8. The image forming apparatus according to claim 1, wherein the second image forming speed is lower than the first image forming speed.

9. The image forming apparatus according to claim 1, wherein the third image forming speed is lower than the first image forming speed, and wherein the third image forming speed is lower than the second image forming speed.

10. The image forming apparatus according to claim 1, wherein the intermediate transfer member is a belt driven by a roller.

* * * * *